US011291319B2

(12) United States Patent
Willingham

(10) Patent No.: US 11,291,319 B2
(45) Date of Patent: Apr. 5, 2022

(54) MICRO-ADJUSTMENT OF CUSHIONS

(71) Applicant: W. Preston Willingham, Winter Park, FL (US)

(72) Inventor: W. Preston Willingham, Winter Park, FL (US)

( * ) Notice: Subject to any disclaimer, the term of this patent is extended or adjusted under 35 U.S.C. 154(b) by 1 day.

(21) Appl. No.: 16/945,219

(22) Filed: Jul. 31, 2020

(65) Prior Publication Data

US 2021/0298498 A1 Sep. 30, 2021

Related U.S. Application Data

(62) Division of application No. 16/836,520, filed on Mar. 31, 2020.

(51) Int. Cl.

| | |
|---|---|
| ***A47G 9/04*** | (2006.01) |
| ***A47G 9/10*** | (2006.01) |
| ***A47G 9/02*** | (2006.01) |

(52) U.S. Cl.

CPC ..... *A47G 9/04* (2013.01); *A47G 9/0253* (2013.01); *A47G 9/10* (2013.01)

(58) Field of Classification Search

CPC ..... A47G 9/04; A47G 9/0253; A47G 9/10

See application file for complete search history.

(56) References Cited

U.S. PATENT DOCUMENTS

| | | | | |
|---|---|---|---|---|
| 6,760,935 | B1 | 7/2004 | Burton et al. | |
| 7,461,424 | B2 | 12/2008 | Lindell | |
| 8,028,360 | B2 | 10/2011 | Regan et al. | |
| 8,572,779 | B2 | 11/2013 | Pratt et al. | |
| 10,321,776 | B2 * | 6/2019 | Hafeznezami ..... | A47G 9/1081 |
| 2014/0373276 | A1 | 12/2014 | Fan | |
| 2018/0325291 | A1 | 11/2018 | Holbrook et al. | |

* cited by examiner

*Primary Examiner* — David R Hare
*Assistant Examiner* — Adam C Ortiz
(74) *Attorney, Agent, or Firm* — Snell & Wilmer L.L.P.

(57) ABSTRACT

A method for adjusting a cushioning element, such as a pillow, by adjusting a length and a volume of a cover of the pillow. The cover includes one or more gathering elements that can alter the length and the volume of the cover. Each gathering element may extend around an end of the cover. Each gathering element may enable adjustment of the length and volume of the cover in extremely small increments or even continuously (i.e., in micro adjustments). Micro-adjustment of the length and volume of the cover may enable adjustment of a position and/or an orientation of at least one endpoint of a closed kinematic chain of an individual's spine, which may provide control over a curvature of the spine.

6 Claims, 23 Drawing Sheets

MICRO-ADJUSTMENT OF CUSHIONS

CROSS REFERENCE TO RELATED APPLICATION

This application is a divisional of U.S. patent application Ser. No. 16/836,520, filed on Mar. 31, 2020 and titled MICRO-ADJUSTABLE COVERS FOR CUSHIONS, the entire disclosure of which is hereby incorporated herein.

TECHNICAL FIELD

This disclosure relates to volume-adjustable covers for cushions, such as pillows, that enable tailoring of the manner in which a cushion supports a load and backfills around and molds to the shape of a supported object to support the object. In some embodiments, volume adjustments may be made in extremely small increments or even continuously, by very small (i.e., "micro") amounts. The length and volume of the cover may be adjusted in a manner that limits or prevents migration of a cushioning element (e.g., an infill material, etc.) within the volume-adjustable cover. In addition, this disclosure relates to cushions that include a cushioning element within a volume-adjustable cover, and to methods for adjusting the manner in which a cushion supports a load at a specific distance from a surface without changing the load deflection attributes of the cushioning element. (e.g., an infill material, etc).

RELATED ART

The American Academy of Sleep Medicine (AASM) divides the sleep cycle into five (5) stages, including the three stages of non-rapid eye movement (NREM) sleep: N1, N2, and N3, the last of which is also called delta sleep or slow-wave sleep. The whole sleep cycle normally proceeds in the order: N1→N2→N3→N2→REM. REM sleep occurs as a person returns to stage 2 or 1 from a deep sleep. An individual typically experiences rejuvenative sleep when he or she goes through the entire sleep cycle; for example, when the individual is able to sleep for eight hours or more. An individual's ability to remain asleep depends in part up on the alignment of the individual's spine as he or she sleeps.

Neutral alignments of the spine are typically necessary for an individual to stay asleep throughout the entire sleep cycle and to return from a deep sleep to stage 1 and stage 2. Neutral alignments of the spine and the joints associated with the spine (e.g., joints at the neck and pelvis, etc.) typically allow the major muscle groups associated with the spine to relax and be in slack while smaller muscle groups may maintain such neutral alignment. By achieving and maintaining neutral alignments of the spine and the joints associated therewith, cerebrospinal sleep signals that trigger cerebrospinal fluid flows may also be achieved with greater efficiency.

When the individual's spine is neutrally aligned and he or she enters into a deep sleep (e.g., N2), the individual's glymphatic system may cleanse his or her brain. The glymphatic system uses cerebrospinal fluid around the brain from the spinal cord to flush out beta-amyloid plaque and other toxins through a series of channels around the brain that expand only during deep sleep. The deeper the sleep, the greater the cleaning of toxins, such as beta-amyloid plaque, which may help prevent so-called "dirty brain diseases" like Alzheimer's disease and Parkinson's disease. Conversely, misalignment of an individual's spine during sleep—even deep sleep—may restrict the flow of cerebrospinal fluid through an individual's spinal cord, which may prevent the glymphatic system from cleansing toxins from the individual's brain.

A variety of different types of cushions have been designed to comfortably support an individual as the individual sits, reclines, and lies down to sleep. Different types of cushions have been designed for various activities. A wide variety of different configurations of cushions have been developed to meet a variety of individual needs and preferences.

Mattresses are a common type of cushion. Some of the highlights of mattress technologies include the development of an early air mattress in 1405 by Konrad Kyser, the invention of the waterbed in 1840 by Neil Arnott, the issuance of the first patent for use of coil springs in bedding in 1865, Heinrich Westphal's invention of the innerspring mattress in 1871, and the U.S. National Aeronautics and Space Administration's (NASA) invention of memory foam in 1966. Conventional bedding technologies are largely based on old sleep sciences, much of which have been refuted. These old, conventional bedding technologies continue to be used and marketed to the detriment of the long-term health and quality of life of many people who sleep on them. Even though solid blocks of form-fitting memory foam, metal spring systems, air volume control systems, and the multitude of natural and synthetic cushioning designs claim to improve sleep, current sleep science studies do not report significant improvements in healthier sleep outcomes for individuals who sleep on conventional mattresses.

Pillows are another common type of cushion. The importance of pillows in association with sleeping surfaces, such as mattresses, has long been recognized. The use of pillows in developed nations is nearly universal, with pillows being commonly used to support and or distribute the weight of the body part over the surface of the cushion, sub surfaces and mattresses. Pillows are commonly used to support an individual's head, neck, chest, arms, shoulders, stomach, pelvis, and knees as he or she sleeps. An individual may select a pillow based on a variety of factors, including shape, size, loft (or height), and firmness (or softness). An individual may also select a pillow based on the nature of the infill material within the pillow (e.g., down, feathers, synthetic fiberfill, shredded foams of all types, and natural buckwheat hulls just to name a few). The specific type of infill material may be chosen by the individual because it provides the individual with a particular sensation or "feel" (e.g., a comfy, cushy, or cuddly feeling to the touch, etc.). The sensation generated as an individual contacts a pillow that includes their personally chosen infill material will send a sleep signal to the ascending reticular activating system (ARAS) of the individual's brain stem.

The manner in which a pillow supports an individual's body part (e.g., his or her head, neck, shoulders, upper back, lower back, chest, stomach, pelvis, thighs, knees, etc.) may be affected a number of variables, including, without limitation, the surface which the individual sleeps (e.g., the firmness of the mattress; an angle at which the mattress is oriented, etc.), the individual's physical state (e.g., pain and/or inflammation in his or her neck, back, or other body parts; weight; physical wellness; etc.). Moreover, the loft and firmness of a pillow typically degrade with repeated use or over time. Thus, a particular pillow may not maintain the characteristics that initially made it desirable to a particular individual (e.g., at the time the individual obtained the pillow) with variations in the individual's sleep environment, the individual's physical state, and other factors, as well as with repeated use and/or over time.

Some pillow makers over fill, or over stuff, new pillows to counteract the effects of aging on the ability of a pillow to support a body part. But over filling a pillow creates tension in the casing of the pillow, which prevents the pillow from receiving and conforming to a load, such as that applied by body part that is placed upon it, which may cause misalignment of an individual's spine. Overfilling also compresses the cushioning material within the pillow, limiting the full extent to which the cushioning material may be compressed when a load is placed upon it, which may limit the ability of the cushioning material to properly receive and support a body part and may orient the individual's head, neck, and/or spine at abrupt angles that may misalign the individual's spine and disrupt the flow of cerebrospinal fluid.

The loft of a pillow and the firmness of a pillow are functions of the fill materials used in the pillow. As disclosed by U.S. Pat. No. 8,028,360 to Regan et al. ("the '360 Patent"), the use of an infill material that comprises particles (e.g., down, feathers, fragments of foam, etc.) generally provides superior comfort, but the fill material typically migrates from beneath a support object, such as an individual's body part, as he or she uses the pillow. Such migration typically results in a decrease in the level of support and comfort provided by the pillow over the course of a short period of time (e.g., as an individual sleeps, etc.). The '360 Patent discloses a system of baffles within the interior of a pillow to limit the extent to which the fill material of the pillow may migrate, but does not mitigate changes in an individual's experience with his or her pillow (i.e., the characteristics that made the pillow desirable at the time the individual obtained it). The '360 Patent discloses a system of baffles but does not allow the user to adjust the baffles, including adjustment of the baffles to accommodate deterioration of infill material within the baffles over time.

Infill materials have been developed to slow the rate at which the infill material settles. Some such infill materials, including those disclosed by U.S. Pat. No. 7,641,424 to Lindell, may include units, or particles, such as pieces of foam with various sizes, that interact with each other in a manner that prevents the units of infill material from settling. These infill materials do not, however, prevent migration or settling of the infill material; instead, the pillow must be periodically fluffed.

Pillow casings with height-adjustable gussets, or side walls, have been designed to enable an individual to tailor the loft and/or firmness of a pillow. The height-adjustable gussets are located around the outer peripheries of the pillow casings, with adjustment of the height-adjustable gussets resulting in changes in the heights of the peripheries of the pillow casings. Examples of such pillow casings are disclosed by U.S. Pat. No. 6,760,935 to Burton et al., U.S. Pat. No. 8,572,779 to Pratt et al., U.S. Patent Application Publication US 2014/0373276 A1 of Fan, and U.S. Patent Application Publication US 2018/0325291 A1 of Holbrook et al. These and other patents teach that pillows may be purposefully over filled, or over stuffed, with infill material to fill the entirety of the casing in a manner that will enable opening of closing of the peripheral gusset to place the pillow in more firm and less firm states. By overstuffing such a pillow, with the peripheral gusset open, the infill material may be fluffed as it settles to maintain some semblance of the pillow's original loft. Alternatively, with the gusset closed and, thus, collapsed, tension may be introduced into the casing, tightening the surface of the casing to provide the appearance of an increase in loft power of the pillow. While the increase in tension may increase the height of the pillow, it also prevents the pillow from receiving and conforming to a load, such as that applied by a head that is placed upon it and limiting the ability of such a pillow to comfortably position an individual's head an optimal distance over a sleep surface and maintain such a distance throughout the sleep cycle (e.g., as the individual's head rests on the pillow for a prolonged period of time, throughout movements that may occur, on average, eight or more times during the individual's normal sleep cycle, etc.).

Pillow casings with adjustable gussets are restricted in their ability to dynamically change the migration of infill materials. The fact that adjustable gussets are limited to the heights of the sidewalls of the pillow casings does not allow for great enough dynamic adjustment to support many objects. While adjustable gussets, in combination with a cushioning element within a pillow casing, introduce sufficient tension into the surface of the pillow casing to be noticed by an individual's hand, the increased tension may not be sufficient to prevent migration of an infill material from beneath many objects, such as an individual's body part. Moreover, the introduction of tension into the pillow casing may prevent the pillow from supporting a body part in its intended manner (e.g., allowing the cushion to receive and form to the shape of the body part, etc.). Further, adjustment of an adjustable gusset undesirably adjusts the shape of a pillow, which is one of the primary factors individuals consider while selecting pillows. The total adjustment is limited to the height of the gusset, which is typically about two inches to about four inches.

Recent sleep science shows that rejuvenative sleep requires more than a temporarily feeling of comfort and support from pillows and mattresses. Unfortunately, many existing mattresses and pillows are unable to position an individuals' body parts in a manner that achieves and maintains the neutral alignments that are often needed to enable the individual to experience rejuvenative sleep.

SUMMARY

No known adjustable or baffled pillow has the range of adjustability to micro-adjust to the multiple variables between different body types, sleep positions, mattress types or sleep surfaces, and changes (e.g., decay, etc.) to each of the foregoing over time.

A volume-adjustable cover for a cushion includes a body and at least one gathering element. When a cushioning element has been introduced into the volume-adjustable cover, the body may have a generally cylindrical shape, which may be partially flattened. As used herein, the term "cylindrical" encompasses elongated three-dimensional shapes with circular cross-sections, elliptical (e.g., partially flattened circular shapes, such as a vesica piscis shape; etc.) cross-sections, oval and ovoid cross-sections, and cross-sections that have other curvilinear shapes, with the cross-section of such a shape being taken normal, or perpendicular, to its longitudinal axis.

Opposite sides of the body, whether it assumes a cylindrical shape or a partially flattened cylindrical shape, are referred to herein as a "first portion" and a "second portion." A receptacle defined by the body, between its first portion and second portion, receives a cushioning element. The body, including its first portion and second portion, may include a first end and a second end, which may be opposite from one another. The first end of the first portion and the first end of the second portion may oppose one another (e.g., be positioned one over the other, at least partially superimposed relative to one another, etc.) and be secured or securable to one another, directly or indirectly, and define a first end of the volume-adjustable cover. Likewise, the second end of the first portion and the second end of the second portion may oppose one another (e.g., be positioned one over the other, at least partially superimposed relative to one another, etc.) and be secured or securable to one another, directly or indirectly, and define a second end of the volume-adjustable cover. Securing the first ends of the first portion and the second portion to each other and/or securing the second ends of the first portion and the second portion to each other may cause the body to assume the at least partially flattened configuration.

A longitudinal axis of the volume-adjustable cover may extend through central locations of the first end and the second end of the volume-adjustable cover. A distance along the longitudinal axis between the first end and the second end may define a length of the volume-adjustable cover. A surface of the volume-adjustable cover is positioned around the longitudinal axis and extends along the length of the volume-adjustable cover. The body of the volume-adjustable cover may be arranged in such a way that the surface may comprise a cylindrical surface and impart the volume-adjustable cover with a cylindrical configuration (e.g., the configuration of an elliptical cylinder (such as a cylinder with the cross-sectional configuration of a vesica piscis), an ovoid cylinder, a circular cylinder, or a cylinder with a cross-sectional shape of any other curvilinear geometric shape).

The body of the volume-adjustable cover may be formed from a pliable material, such as a fabric, a polymer film, or the like. The first portion and the second portion of the body of the volume-adjustable cover may comprise a single sheet of material that may define both the first portion and the second portion. Alternatively, the body may be formed from separate elements that are secured to one another.

The receptacle of the volume-adjustable cover may have a configuration that enables it to receive a cushioning element. The cushioning element may comprise a fill material that, along with the volume-adjustable cover, may form a cushion. Alternatively, the cushioning element may comprise a preformed cushion. In any event, the relaxed volume of the cushioning element may be less than the maximum volume of the volume-adjustable cover. In addition, the cushioning element may comprise a structure and/or material whose loft can be adjusted.

The volume-adjustable cover may be used with or have a configuration that defines any of a variety of different types of cushioning elements. Some non-limiting examples of cushioning elements include pillows, seat cushions (e.g., cushions that have been integrated into a seat, portable seat cushions, etc.), mattress toppers, mattresses, and the like. A volume-adjustable cover according to this disclosure may also act as fill elements for cushions, such as sleeping bags, clothing (e.g., coats, vests, etc., with thermally insulating infill materials), and the like.

The gathering element of the volume-adjustable cover may be located adjacent to an end of the volume-adjustable cover. In embodiments where the volume-adjustable cover includes two gathering elements, the gathering elements may be located adjacent to opposite ends of the volume-adjustable cover (i.e., the first end and the second end of the volume-adjustable cover). Each gathering element may be capable of adjusting the length and a volume of the volume-adjustable cover. Adjustment of the length and/or volume of the volume-adjustable cover may adjust the extent to which a material of the cushioning element within a receptacle of the volume-adjustable cover may migrate, or flow, away from an object supported by the volume-adjustable cover and the cushioning element. In some embodiments, the gathering element may be capable of progressively adjusting (i.e., decreasing, increasing) a length and a volume of the volume-adjustable cover and of progressively limiting the extent to which the cushioning material may migrate away from a supported object. The changes in length and volume and the limitations on migration may be incremental or infinite, depending on the configuration of the gathering element. A gathering element may extend around the longitudinal axis and the surface of the volume-adjustable cover. In specific embodiments, the gathering element may extend helically around the longitudinal axis and the surface of the volume-adjustable cover. In embodiments where a gathering element is positioned at or adjacent to an end of the body of the volume-adjustable cover and extends around a circumference of the body, the gathering element may be adjusted with affecting an overall shape of the portion of the volume-adjustable cover and/or a cushioning element therein that supports an object.

In some embodiments, the gathering element may comprise an elongated fastening device with a pair of elements, or engaging features, that are spaced apart from one another and that are capable of engaging, or coupling to, one another. The engaging features of the elongated fastening device may be oriented parallel to one another or substantially parallel to one another. In embodiments where the gathering element comprises an elongated fastening device, the gathering element may extend at least partially around the longitudinal axis and the surface of the volume-adjustable cover. In some embodiments, the gathering element may extend more than once around the longitudinal axis and the surface of the volume-adjustable cover (e.g., about 540°, or 1½ times, around the volume-adjustable cover; twice, or about 720°, around the volume-adjustable cover; etc.). In embodiments where the gathering element extends more than once around the volume-adjustable cover, the gathering element may be somewhat helically oriented. In other embodiments, the gathering element may extend completely around the longitudinal axis and the surface of the volume-adjustable cover (e.g., helically, etc.). In still other embodiments, the gathering element may extend substantially completely around the longitudinal axis and the surface of the volume-adjustable cover (e.g., slightly less than 360°, accounting for adjacent ends of a circumferentially oriented gathering element; etc.).

When uncoupled, the engaging features of the elongated fastening device of the gathering element may be secured to spaced apart locations of the volume-adjustable cover that extend generally around the longitudinal axis and the surface of the volume-adjustable cover. The spaced apart locations of the volume-adjustable cover may be parallel to one another, substantially parallel to one another, at a gradually increasing distance apart from one another (e.g., in a V-shaped arrangement, etc.), or in any other suitable spaced apart arrangement. Thus, the engaging features may extend across and be carried by both the first portion and the second portion of the volume-adjustable cover, transverse to its length. The engaging features may be spaced apart from one another when the elongated fastening device and, thus, the gathering element is in a relaxed arrangement (e.g., unzipped, etc.). The portions of the body between the engaging features may be referred to as an "adjustment region" of the body. As the engaging features are drawn together (e.g., by closing the zipper, with buttons, with lacing, etc.), they place the elongated fastening device and, thus, the gathering element in a gathered arrangement. As the elongated fastening device is placed in the gathered arrangement, and as the gathered arrangement progresses along the length of the gathering element, the elongated fastening device pulls portions of the body of the volume-adjustable cover that are located between the engaging features toward each other. The extent to which the portions of the body of the volume-adjustable cover between the engaging features are pulled, or gathered, together around the volume-adjustable cover and, thus, the extent of the gathered arrangement around the volume-adjustable cover depends upon the extent to which the lengths of the engaging features of the gathering element have been pulled together. Placement of the elongated fastening device in the gathered arrangement may decrease the length of at least a portion of the volume-adjustable cover, as well as the volume of the volume-adjustable cover, to an extent that exceeds the adjustability of existing covers with adjustable gussets or baffles. The extent of the gathered arrangement may define the extent of any decrease in the length of the volume-adjustable cover and the extent of any decrease in the volume of the volume-adjustable cover.

By placing each gathering element adjacent to an end of the volume-adjustable cover, and by using the volume-adjustable cover with a cushioning element whose relaxed volume does not exceed the maximum volume of the volume-adjustable cover, the gathering element may be adjusted to decrease the volume of the volume-adjustable cover to limit migration of the cushioning material of the cushioning element and/or loft of the cushioning element without introducing noticeable tension (e.g., no tension, substantially no tension, etc.) into the volume-adjustable cover itself.

In another aspect, a cushion according to this disclosure includes a volume-adjustable cover and a cushioning element with a receptacle of the volume-adjustable cover. The cushioning element may be removably received within the receptacle. For example, the volume-adjustable cover may include a closeable opening that enables it to be used with any of a variety of different preformed cushioning elements (e.g., pillows, etc.), which may enable an individual to select a preformed cushioning element, and then adjust, or fine tune, one or more characteristics of that cushioning element. In some embodiments, the preformed cushioning element may comprise a cover that contains a so-called "infill" material. An infill material includes separate units, or particles, of one or more materials. The separate particles may be able to flow past one another. A cushioning element that includes an infill material may be referred to herein as an "infill cushion."

As an alternative to receiving a preformed cushioning element, a receptacle of a volume-adjustable cover may directly receive a loose infill material. In some such embodiments, the volume-adjustable cover may include an opening and a corresponding closure that enable an individual to remove a portion of the loose infill material from the receptacle or add more of the infill material to the receptacle. In other embodiments, the infill material may be permanently retained within the receptacle; for example, the infill material may be sewn or otherwise sealed in the receptacle of the volume-adjustable cover. The maximum volume of the volume-adjustable cover may equal or exceed the volume of loose infill material therein; i.e., the infill material within the volume-adjustable cover may not be compressed, or the volume-adjustable cover may not be overstuffed.

The volume-adjustable cover of a cushion according to this disclosure may include one or more gathering elements. Adjustment of the gathering element(s) may adjust a length of at least a portion of the volume-adjustable cover, as well as a volume of the volume-adjustable cover. Adjustment of the length of a least a portion of the volume-adjustable cover may limit the extent to which a cushioning material of a cushioning element within the volume-adjustable cover may migrate away from an object (e.g., a body part, etc.) supported by the volume-adjustable cover and the cushioning element, and may limit the extent to which the cushioning material may migrate toward the object. Thus, adjustment of the gathering element(s) may enable an individual to control migration of the cushioning material away from or even toward the supported object, including the rate at which the cushioning material migrates and the extent to which the cushioning material migrates. By controlling the rate of migration, the loft of the cushioning element may also be controlled.

In embodiments where the cushioning element comprises an infill material, adjustment of the gathering element(s) of the volume-adjustable cover may limit lateral migration of the infill material, including its migration away from or even toward an object supported by the cushioning element. The volume-adjustable cover may also enable the infill material within the cushioning element to mold to a shape of the supported object. As those of ordinary skill in the art will appreciate, different infill materials may migrate at different rates from one another. Differences in the migration rates of different materials may be due to any of a variety of different factors, such as the type of infill material (or types of infill materials where mixtures or blends of infill materials are employed), the particle size(s) of the infill material (e.g., average particle size, range of particle sizes, etc.), the shape(s) of the particles of the infill material, among any of a variety of other factors.

In some embodiments, the volume-adjustable cover may be adjusted without affecting the firmness or softness, or the general cushioning effect, of the cushioning element (e.g., an infill material, etc.) therein. In other embodiments, adjustment of the length of the volume-adjustable cover may adjust one or more characteristics of the cushioning element, such as a speed of return of the cushioning element and a distance the cushioning element can maintain a supported object over a surface on which the cushion rests.

A method according to this disclosure includes adjusting a cushion. Such a method may include adjusting the length and volume of a volume-adjustable cover. The length and volume of the volume-adjustable cover may be adjusted from a location that surrounds at least a portion of the longitudinal axis of the volume-adjustable cover, which extends through a length of the volume-adjustable cover, and around the surface of the body of the volume-adjustable cover. Adjustment of the length and volume of the volume-adjustable cover may occur from one or more edges (e.g., an end, opposite ends, etc.) of the volume-adjustable cover.

By adjusting the length and volume of the volume-adjustable cover, the extent to which a cushioning material of a cushioning element of the volume-adjustable cover migrates may be limited, including the extent to which the cushioning material migrates away from an object supported by the volume-adjustable cover and the cushioning element and even the extent to which the cushioning material migrates toward an object supported by the volume adjustable cover. Adjustment of the length of the volume-adjustable cover and, thus, the extent to which the volume-adjustable cover limits migration of the cushioning material of a cushioning element within the receptacle of the volume-adjustable cover may enable an individual to adjust, or tailor, one or more characteristics of the cushioning element and, thus, of the cushion. Without limitation, in embodiments where the cushioning element comprises a loose infill material, the individual may adjust the length of the volume-adjustable cover to cause the infill material to move into place around a supported object, such as an individual's body part (e.g., his or her head, neck, shoulders, upper back, lower back, chest, stomach, pelvis, thighs, knees). For example, the individual may tailor the length of the volume-adjustable cover, another individual may tailor the length of the volume-adjustable cover, etc.). As other examples, the individual may tailor one or more firmness characteristics of the cushioning element, a speed of return of the cushioning element, and a load deflection of the cushioning element as the cushioning element supports an object, including a distance the cushioning element can maintain a supported object (e.g., a human head in embodiments where the cushion is a pillow, other body parts, etc.) over a surface on which the cushion rests.

The gathering element(s) may also be adjusted in a manner that enables the volume-adjustable cover and a cushioning element therein to support an object (e.g., a body part, such as an individual's head, knee, back, etc.) of any of a variety of different weights, dimensions, shapes, etc., at a desired elevation above a surface that supports the volume-adjustable cover and the cushioning element. Adjustment of the gathering element(s) of a volume-adjustable cover may enable a cushioning element within the volume-adjustable cover to support an object with a weight and dimensions that would otherwise cause an infill material to migrate from beneath the object (e.g., an object with a weight of more than 10 pounds (i.e., about 4.55 kg), more than 12 pounds (about 5.45 kg), more than 15 pounds (about 6.82 kg), etc.), to hold at least some of the infill material beneath the object. Adjustment of the gathering element(s) of a volume-adjustable cover may vary the extent to which the volume-adjustable cover and the cushioning element therein deflect loads. In these manners, adjustment of the gathering element (s) may ensure that the object is held at a desired elevation above the surface that supports the volume-adjustable cover.

The gathering element(s) may also be adjusted in a manner that enables the volume-adjustable cover to mold the cushioning element (e.g., an infill material, etc.) beneath and around an object as the object is supported by the volume-adjustable cover and the cushioning element therein. Such an adjustment may be made without affecting the softness or firmness characteristics of the cushioning element or the overall cushioning effect of the volume-adjustable cover and the cushioning element therein.

The gathering element(s) of a volume-adjustable cover according to this disclosure may enable dynamic adjustment of the volume of a volume-adjustable cover. As used herein, "dynamic adjustment" use of one or more gathering elements adjust of the volume of the volume-adjustable cover, including fine adjustments to the volume of the volume-adjustable cover. Such dynamic adjustment may occur while the volume-adjustable cover and a cushioning element therein support an object, such as a body part of an individual. Dynamic adjustment may involve adjustment of one or more gathering elements, followed by feedback by the individual, optionally followed by further adjustment of one or more gathering elements. Stated another way, adjustment of the gather element(s) may be repeated, or a plurality of adjustments may be made, to optimize the manner in which the volume-adjustable cover and the cushioning element therein support an object (e.g., comfort to an individual's body part, etc.).

Such methods may involve use of a cushion that includes a volume-adjustable cover according to this disclosure, which includes one or more gathering elements. In some embodiments, a volume-adjustable cover may be part of the cushion. In other embodiments, the cushion may be provided as an individual introduces a cushioning element (e.g., a pillow, etc.) of his or her choice into the receptacle of a volume-adjustable cover. In embodiments where the cushion comprises a pillow, adjustment of the length of the volume-adjustable cover and the compressive forces the volume-adjustable cover applies to the cushioning element of the pillow may include adjusting the length of the volume-adjustable cover to tailor the pillow in a manner that optimizes an individual's comfort in a particular sleep environment. The compressive forces the volume-adjustable cover applies to the cushioning element of the pillow may limit migration of cushioning material (e.g., an infill material, etc.) away from the individual's head or other body part and even form the infill material of the cushioning element to a desired shape (e.g., mold it around the individual's head or other body part, etc.). By limiting movement of the cushioning material of the cushioning element, the individual's head or other body part may be comfortably positioned (e.g., to a particular elevation, etc.) in a sleeping position (e.g., at a sleeping elevation, etc.) and/or in a waking position (e.g., at a waking elevation, etc.). Similarly, use of a volume-adjustable cover with another embodiment of cushioning element may enable adjustment of the cushioning element in a manner that will cause the cushioning element to mold to the shape of an object supported by the cushioning element and the volume-adjustable cover and/or optimize one or more of the manner in which the cushioning element supports the object, the location (e.g., elevation, etc.) at which the cushioning element supports the object, and the comfort provided to the object in each environment in which the cushioning element is used. More specifically, a volume-adjustable cover may be used in a way that enables a cushion of which it is a part to be adjusted to one or more body specifications of the individual whose body part(s) is (are) being supported by the cushion (or a plurality of the cushions), a preferred sleeping position of the individual, and/or a relationship of the cushion to a sleeping surface used by the individual.

Other aspects of this disclosure, as well as features and advantages of various aspects of this disclosure, should become apparent to those of ordinary skill in the art through consideration of the ensuing disclosure, the accompanying drawings, and the appended claims.

BRIEF DESCRIPTION OF THE DRAWINGS

In the drawings:

FIGS. 12A-1, 12A-2, and 12A-3 are perspective views depicting the extent to which a cushion is deformed when an object of fixed weight is placed thereon with the volume-adjustable cover in the relaxed arrangement, a partially gathered arrangement, and the fully gathered arrangement, respectively;

FIGS. 12B-1, 12B-2, and 12B-3 are cross-sectional representations depicting the extent to which a cushion is deformed when an object of fixed weight is placed thereon with the volume-adjustable cover in the relaxed arrangement, a partially gathered arrangement, and the fully gathered arrangement, respectively;

DETAILED DESCRIPTION

Figure 1:
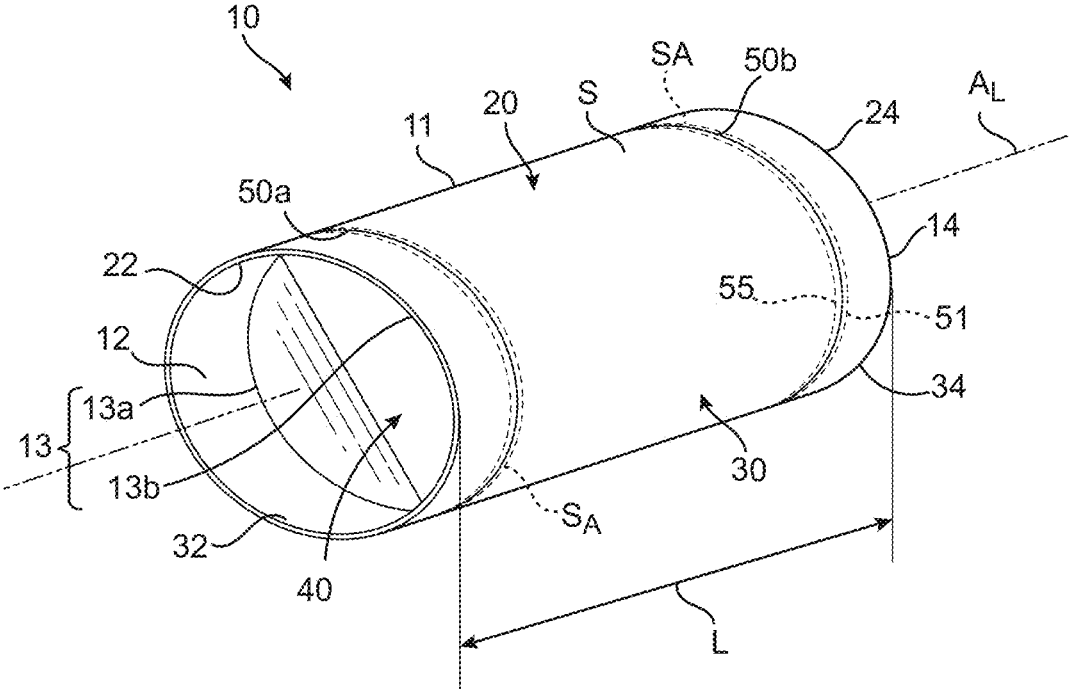
FIG. 1 is a perspective view of an embodiment of a volume-adjustable cover according to this disclosure, with an end of the volume-adjustable cover open to provide access to a receptacle within an interior of the volume-adjustable cover.

FIG. 1 depicts an embodiment of a volume-adjustable cover 10 according to this disclosure. The volume-adjustable cover 10 includes a body 11 with ends 12 and 14 that are opposite from one another. The body 11 of the volume-adjustable cover 10 includes a first portion 20 and a second portion 30, which oppose each other (e.g., are positioned one over the other, in at least partially superimposed relation, etc.). A receptacle 40, which can receive a cushioning element (not shown in FIG. 1) (e.g., a pillow, a seat cushion, etc.), is located between and defined by the first portion 20 and the second portion 30. The volume-adjustable cover 10 also includes at least one gathering element 50*a*, 50*b*, which may adjust an effective length and a volume of the volume-adjustable cover 10 in a manner that may adjust the extent to which the volume-adjustable cover 10 limits migration of a cushioning material of a cushioning element within a receptacle 40 of the volume-adjustable cover 10. In the depicted embodiment, the volume-adjustable cover 10 includes two gathering elements 50*a* and 50*b*, one adjacent to each end 12, 14 of the volume-adjustable cover 10. For the sake of simplicity, the reference number 50 may be used hereinafter to refer to one or more gathering elements 50*a*, 50*b*, etc., of the volume-adjustable cover 10.

A longitudinal axis $A_L$ of the volume-adjustable cover 10 may extend through central locations of the first end 12 and the second end 14 of the volume-adjustable cover 10. A distance along the longitudinal axis $A_L$ between the first end 12 and the second end 14 may define a length L of the volume-adjustable cover 10. A surface S of the volume-adjustable cover 10 and its body 11 is positioned around the longitudinal axis $A_L$ and extends along the length L of the volume-adjustable cover 10.

The body 11 of the volume-adjustable cover 10 may assume a somewhat cylindrical configuration. The use of a pliable material to define the body 11 may enable the body 11 to assume such a configuration. As a few examples, the body 11 may be formed as a cylinder, from a single sheet of material with opposite edges that are secured together to provide a body 11 that can assume a cylindrical configuration, or from multiple sheets of material that are secured together in a manner that enables the body 11 to assume a cylindrical configuration. Some non-limiting examples of pliable materials from which the body 11 may be formed include fabrics, polymer films, and the like.

The surface S of the body 11 of the volume-adjustable cover 10 may include a first portion 20 and the second portion 30 of the volume-adjustable cover 10 are generally opposite from one another. The first portion 20 may include a first end 22 and a second end 24, which may be opposite from one another. The second portion 30 may also include a first end 32 and a second end 34, which may be opposite from one another. The first end 22 of the first portion 20 and the first end 32 of the second portion 30 may oppose one another (e.g., be positioned one over the other, in superimposed relation, etc.) and be secured or securable to one another, directly or indirectly, and define the first end 12 of the volume-adjustable cover 10. Likewise, the second end 24 of the first portion 20 and the second end 34 of the second portion 30 may oppose one another (e.g., be positioned one over the other, in superimposed relation, etc.) and be secured or securable to one another, directly or indirectly, and define a second end 14 of the volume-adjustable cover 10.

In the embodiment of volume-adjustable cover 10 depicted by FIG. 1, the first end 12 may comprise an opening and include one or more fasteners 13, which may enable the first end 12 to be selectively opened and closed, providing selective access to the receptacle 40 between the first portion 20 and the second portion 30. Each fastener 13 may comprise a first element 13*a* and a second element 13*b* that complement one another, with the first element 13*a* being able to engage the second element 13*b*, the first element 13*a* being able to be engaged by the second element 13*b*, or the first element 13*a* and the second element 13*b* being able to mutually engage one another. The first element 13*a* may be defined or carried by the first portion 20 of the volume-adjustable cover 10, at or adjacent to the first end 22 of the first portion 20. The second element 13*b* may be defined or carried by the second portion 30 of the volume-adjustable cover 10, at or adjacent to the first end 32 of the second portion 30. In some embodiments, the fastener 13 may also include an engagement element 13E, which may enable or facilitate engagement and/or disengagement of the first element 13*a* and the second element 13*b* of the fastener.

As one of the first element 13*a* and the second element 13*b* of a fastener 13 of the volume-adjustable cover 10 is brought toward the other of second element 13*b* and the first element 13*a*, or as the first element 13*a* and the second element 13*b* are brought together, one or both of the first end 22 of the first portion 20 and the first end 32 of the second portion 30 is pulled toward the other. By causing one or both of the first element 13*a* and the second element 13*b*, or a portion thereof, to engage the other of the second element 13*b* and the first element 13*a*, or a portion thereof, the first end 22 of the first portion 20 and the first end 32 of the second portion 30 are at least partially secured to one another, least partially closing the first end 12 of the volume-adjustable cover 10. By disengaging the first element 13*a* and the second element 13*b* of the fastener 13, or at least portions thereof, corresponding portions of the first end 22 of the first portion 20 and the first end 32 of the second portion 30 may be released from one another, enabling those corresponding portions of the first end 22 and the second end 32 to be pulled apart from one another and, thus, enabling the first end 12 of the volume-adjustable cover 10 to be at least partially opened.

Without limitation, the fastener 13 of the volume-adjustable cover 10 may comprise a zipper. A first side of the zipper may comprise the first element 13*a* of the fastener 13 and may be sewn or bonded to the first portion 20 of the volume-adjustable cover 10, at or adjacent to the first end 22 of the first portion 20. A second side of the zipper may comprise the second element 13*b* of the fastener 13 and may be sewn or bonded to the second portion 30 of the volume-adjustable cover 10, at or adjacent to the first end 32 of the second portion 30. A slide of the zipper may comprise an engagement element 13E of the fastener 13. Other embodiments of fasteners 13 that may be used at the first end 12 of a volume-adjustable cover 10 include, but are not limited to buttons and correspondingly sized and positioned button holes, snap fasteners, touch fasteners (e.g., the hook-and-loop fasteners commonly referred to as "velcro" fasteners, hook-and-hook fasteners, etc.), magnetic fasteners, lacing systems, and the like.

The receptacle 40 of the volume-adjustable cover 10 may have a configuration that enables it to receive a cushioning element (not shown in FIG. 1), such as a preformed cushion or an infill material that, along with the volume-adjustable cover 10, may form a cushion. The volume-adjustable cover 10 may be used with or have a configuration that defines any of a variety of different types of cushioning elements. Some non-limiting examples of cushioning elements that may be carried by the receptacle 40 include pillows, cushions (e.g., seat cushions, such as cushions that have been integrated into a seat, portable seat cushions, etc.; orthopedic cushions, such as positioning cushions, cushions of braces, etc.; etc.), mattress toppers, mattresses, and the like.

Each gathering element 50 of the volume-adjustable cover 10 may be located adjacent to an end of the volume-adjustable cover 10. In embodiments where the volume-adjustable cover 10 includes two gathering elements 50, the gathering elements 50 may be located adjacent to opposite ends of the volume-adjustable cover 10 (i.e., the first end 12 and the second end 14 of the volume-adjustable cover 10).

Each gathering element 50 may be capable of adjusting the length L and a volume of the volume-adjustable cover 10. As an example, each gathering element 50 may adjust the length L of the volume-adjustable cover by shortening or extending the distance across a corresponding adjustment region $S_A$ of the surface S of the body 11 in a direction that extends substantially along the length L of the volume-adjustable cover 10. The adjustment region $S_A$ of the surface S may comprise a region of the surface S resembling a strip that extends around the surface S and surrounds the longitudinal axis $L_A$ of the volume-adjustable cover 10. In some embodiments, the adjustment region $S_A$ may be oriented somewhat helically around the longitudinal axis $L_A$. The gathering element 50 may decrease the length L of the volume-adjustable cover 10 by drawing together edges 51 and 55 of the adjustment region $S_A$ that are oriented transverse to the longitudinal axis $L_A$ of the volume-adjustable cover 10 along at least a portion of the adjustment region $S_A$ and gathering together material $S_M$ located between the portions of the edges 51 and 55 of the adjustment region $S_A$ that are drawn together. Conversely, the gathering element 50 may increase the length L of the volume-adjustable cover 10 by enabling edges 51 and 55 of the adjustment region $S_A$ to be moved apart from one another and allowing material between the edges to spread out. Use of the gathering element 50 may enable adjustment of the length of the volume-adjustable cover 10 in a micro-controlled fashion. Changes in the length of the volume-adjustable cover 10 may translate to corresponding changes in a volume of the volume-adjustable cover 10. Changes in the length and/or volume of the volume-adjustable cover 10 may translate to limits on the extent to which the volume-adjustable cover 10 places on the ability of a cushioning material of a cushioning element (not shown in FIG. 1) within the receptacle 40 of the volume-adjustable cover 10 to migrate away from an object supported by the volume-adjustable cover 10 and the cushioning element. The changes in length, volume, and limits on the ability of the cushioning material to migrate may be incremental or infinite, depending on the configuration of the gathering element 50.

One or more gathering elements 50 may be positioned so as to extend around the surface S of the body 11 of the volume-adjustable cover 10 in a manner that at least partially encircles (e.g., helically, as depicted by FIG. 1; etc.) the longitudinal axis $A_L$ of the volume-adjustable cover 10. Each gathering element 50 may include a pair of elements 52 and 54 positioned at corresponding locations at or adjacent to opposite edges of the adjustment region $S_A$ of the surface S of the body 11.

Figure 1A:
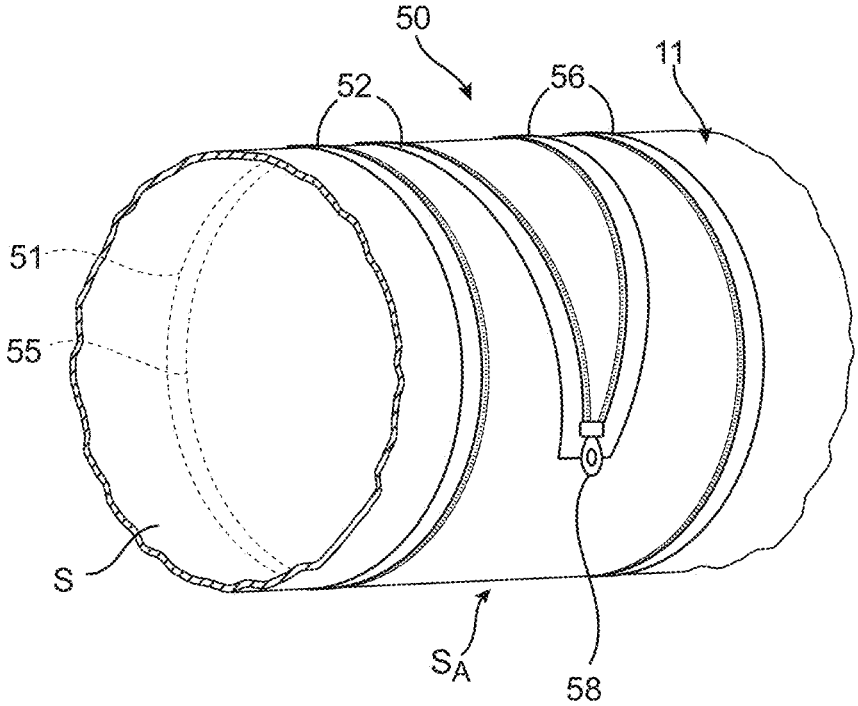
FIGS. 1A-1C depict various embodiments of gathering elements of volume-adjustable covers according to this disclosure.
Figure 1B:
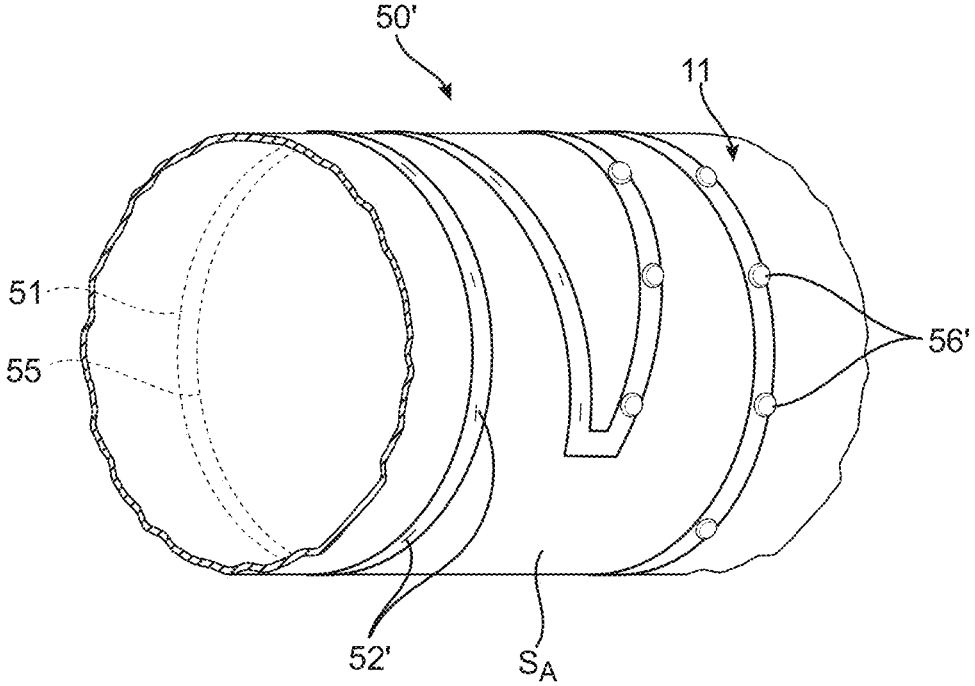
Figure 1C:
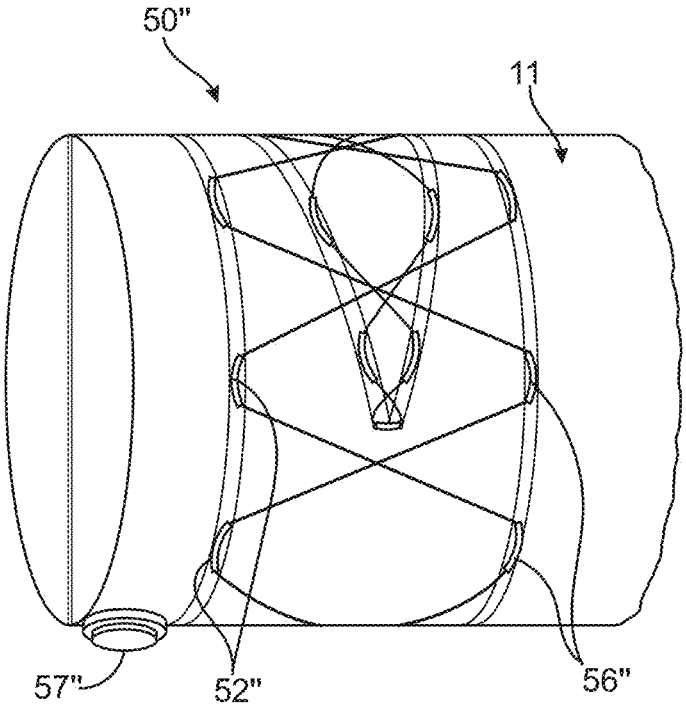

The volume-adjustable cover 10 may include one or more gathering elements 50 that are elongated. An elongated gathering element 50 may include a pair of engaging features 52 and 56 that may complement and/or cooperate with one another. With the gathering element 50 in a relaxed arrangement, the engaging features 52 and 56 may spaced apart from one another and capable of engaging, or coupling to, one another. Each engaging feature 52, 56 may be positioned along a corresponding edge 51, 55, respectively, of the adjustment region $S_A$ of the surface S of the body 11 of the volume-adjustable cover 10 with which the gathering element 50 is associated. The edges 51 and 55 and, thus, the engaging features 52 and 56 may be arranged parallel to one another, substantially parallel to one another, at a gradually increasing distance apart from one another (e.g., in a V-shaped arrangement, etc.), in any other suitable spaced apart arrangement, or in any combination of suitable arrangements. As depicted by FIG. 1A, when the gathering element 50 is in a relaxed arrangement, first ends of the engaging features 52 and 56 and their corresponding edges 51 and 55 of the adjustment region $S_A$ of the surface S of the body 11 of the volume-adjustable cover may have a V-shaped arrangement, then transition to a parallel arrangement farther along the length of the gathering element 50. FIGS. 1B and 1C show similar arrangements with other embodiments of gathering elements 50' and 50".

In addition to the engaging features 52 and 56, the gathering element 50 may include one or more fastening elements 58, which may draw the engaging features 52 and 56 toward each other and fasten them together (e.g., cause them to mutually engage one another, etc.) and which may separate the engaging features 52 and 56 from one another. As shown in FIG. 1A, in a specific embodiment, the gathering element 50 may comprise a zipper, with the engaging features 52 and 56 comprising teeth on complementary sides of a ribbon of the zipper and each fastening element 58 comprising a slide of the zipper.

In other embodiments of gathering elements 50', as depicted by FIG. 1B, the volume-adjustable cover 10 may include a series of discrete (i.e., not substantially elongated) gathering elements 50'. In such embodiments, a first series 53' of engaging features 52' may be positioned at or adjacent to a first edge 51 of the adjustment region $S_A$ of the surface S of the body 11 of the volume-adjustable cover 10 at spaced apart intervals, while a second series 57' of engaging features 56' may be positioned at or adjacent to a second edge 55 of the adjustment region $S_A$ at spaced apart intervals. The intervals between adjacent engaging features 52' of the first series 53' may be the same, or uniform, along at least a portion of the first series 53' or across an entirety of the first series 53'. Alternatively, different pairs of engaging features 52' of the first series 53' may be spaced different distances apart from one another. The spacing between adjacent engaging features 56' of the second series 57' may correspond to, or mirror, the spacing between their corresponding adjacent engaging features 52' of the first series 53, aligning each engaging feature 52' with its corresponding engaging feature 56'.

As another option, as shown in FIG. 1C, a volume-adjustable cover 10 may include one or more gathering elements 50", each of which includes eyelets 52" and 56", as well as a lace 58". More specifically, a first series 53" of eyelets 52" (e.g., apertures, loops, channels, etc.) may be positioned at or adjacent to a first edge 51 of the adjustment region $S_A$ of the surface S of the body 11 of the volume-adjustable cover 10 at spaced apart intervals. A second series 57" of eyelets 56" may be positioned at or adjacent to a second edge 55 of the adjustment region $S_A$ of the surface S of the body 11 of the volume-adjustable cover 10 at spaced apart intervals. The intervals between the eyelets 52" of the first series 53" and the eyelets 56" of the second series 57" may be the same, or uniform along at least a portion of the first series 53" and the second series 57" or along the entire first series 53" and second series 57". Alternatively, different pairs of eyelets 52", 56"—each pair including an eyelet 52" of the first series 53" and its adjacent eyelet 56" of the second series 57"—may be spaced different distances apart from one another. As an example, adjacent pairs of eyelets 52" and 56" of a gathering element 50" may be spaced apart from one another at distances that gradually increase along the length of the gathering element 50". The lace 58 may pass through the eyelets 52", 56" in a known manner to adjust the distance the first edge 51 and the second edge 55 of the adjustment region $S_A$ are spaced apart from each other at different locations along the length of the gathering element 50".

With returned reference to FIG. 1, each gathering element 50 may extend completely around the surface S of the body 11 of the volume-adjustable cover 10, transverse to the longitudinal axis $L_A$ of the volume-adjustable cover 10. The engaging features 52 and 56 of the gathering element 50 may be gathered at any distance along the length of the gathering element 50, and may lock into place the extent to which the first edge 51 and the second edge 55 of the adjustment region $S_A$ of the surface S of the body 11 of the load support over 10 is gathered together. As depicted, each gathering element 50 may be oriented helically around the longitudinal axis $L_A$ and the surface S. In a specific embodiment, each gathering element 50 may extend about 540°, or about 1½ times, around the longitudinal axis $L_A$ and the surface S. In other embodiments, a gathering element 50 may extend a different distance around the longitudinal axis $L_A$ and the surface S. Without limitation, a gathering element 50 may extend around the longitudinal axis LA and the surface once (i.e., about 360°), twice (about 720°), or any other value. In still other embodiments, a gathering element 50 may extend substantially around the longitudinal axis $L_A$ and the surface S, with the term "substantially" indicating, for example, that adjacently position ends of a circumferentially oriented gathering element 50 may prevent the gathering element 50 from extending completely around the longitudinal axis $L_A$ and the surface S.

The effects of different arrangements of a gathering element 50 on a cushioning element 60 (FIGS. 10A-11F) that substantially fills the receptacle 40 (FIG. 1) of the volume-adjustable cover 10 are illustrated by FIGS. 2A-9B and described in reference to those drawings.

Figure 2A:
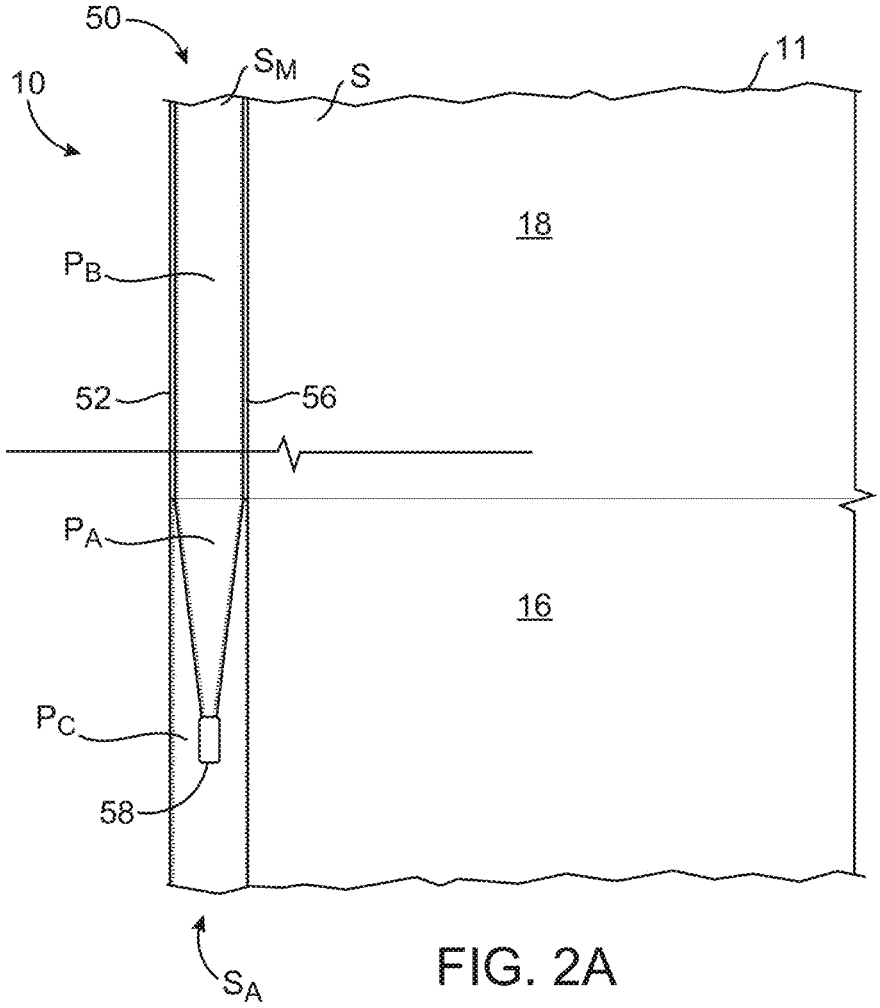
FIGS. 2A-2G illustrate use of the gathering element to decrease (and, in reverse, to increase) the volume of the volume-adjustable cover in a progressive and compound manner.
Figure 2B:
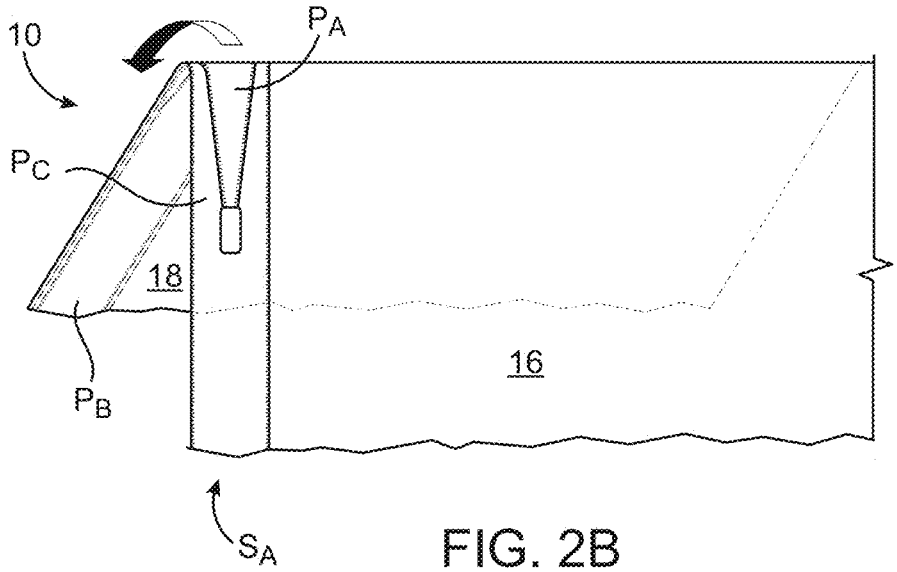
Figure 2C:
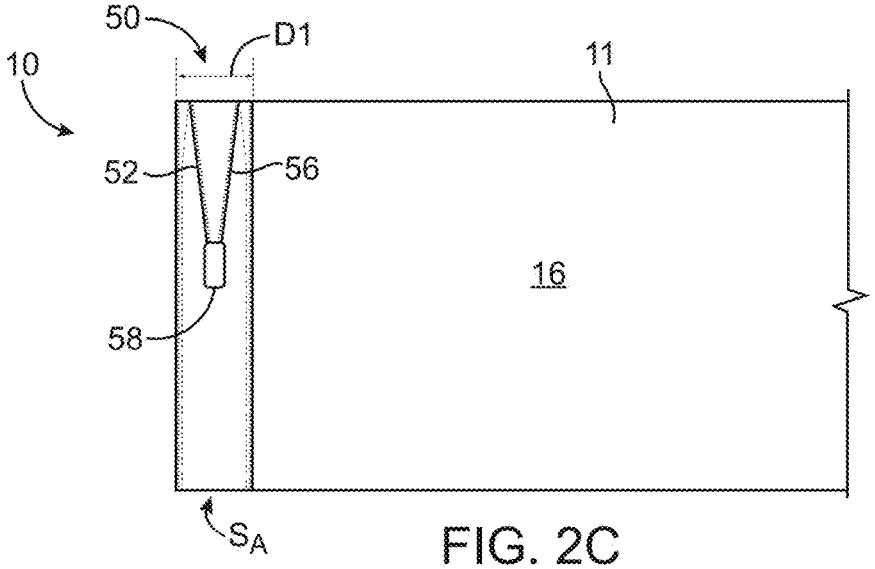

FIGS. 2A-2G illustrate progressive gathering by a gathering element 50 of a volume-adjustable cover 10. FIGS. 2A-2C, 3A, and 3B illustrate a first side 16 and a second side 18 of the volume-adjustable cover 10 with the gathering element 50 in its relaxed arrangement. The fastening element 58 of gathering element 50 is positioned such that the engagement features 52 and 56 are spaced apart from one another along the entire length of the fastening element 50. FIGS. 2A, 3A, and 3B also depict various regions $P_A$, $P_B$, and $P_C$ where the material $S_M$ of the adjustment region $S_A$ on the surface S of the body 11 may be pleated as the fastening element 58 progressively gathers the engagement features 52 and 56 of the gathering element 50 together. While in the relaxed arrangement, the adjustment region $S_A$ may realize its maximum width, a distance D1.

Figure 2D:
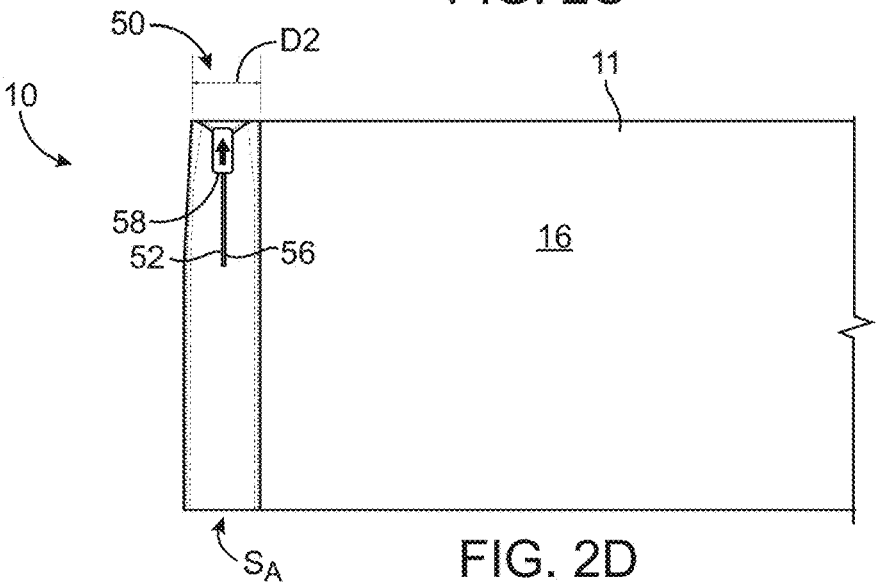
Figure 3A:
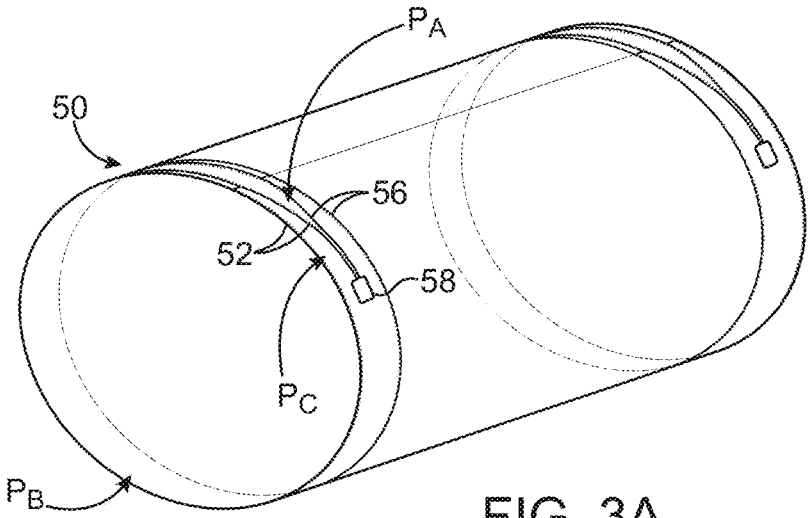
FIG. 3A is a perspective view of a volume-adjustable cover that shows the locations where the first pleat, the second pleat, and the third pleat are formed as a gathering element is gathered progressively along its length.
Figure 3B:
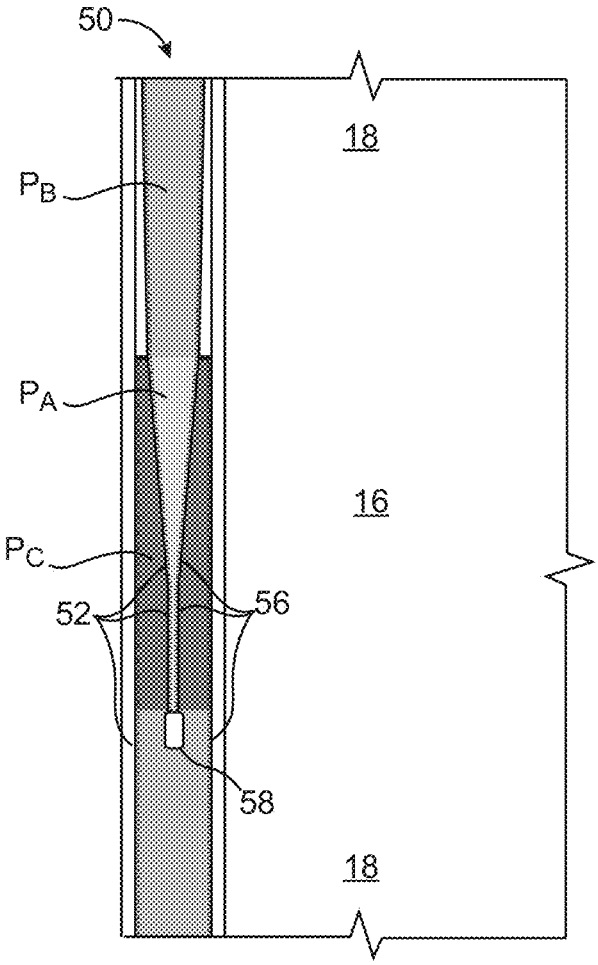
FIG. 3B depicts the entire length of a gathering element, illustrating the locations where fabric is gathered to define each of the first pleat, the second pleat, and the third pleat.
Figure 4A:
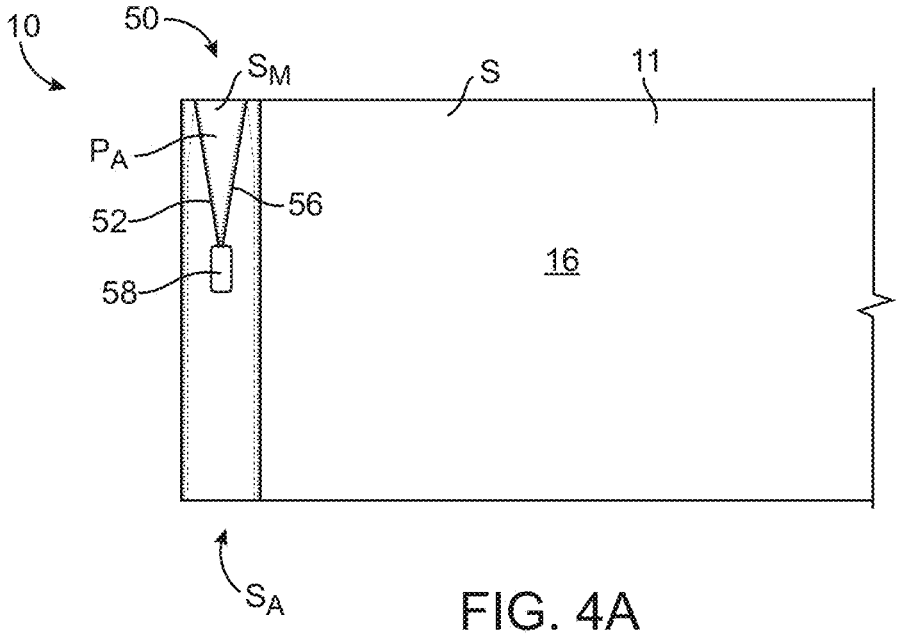
FIGS. 4A-4D show, from various perspectives, the gathering element of a volume-adjustable cover in a fully relaxed arrangement.
Figure 4B:
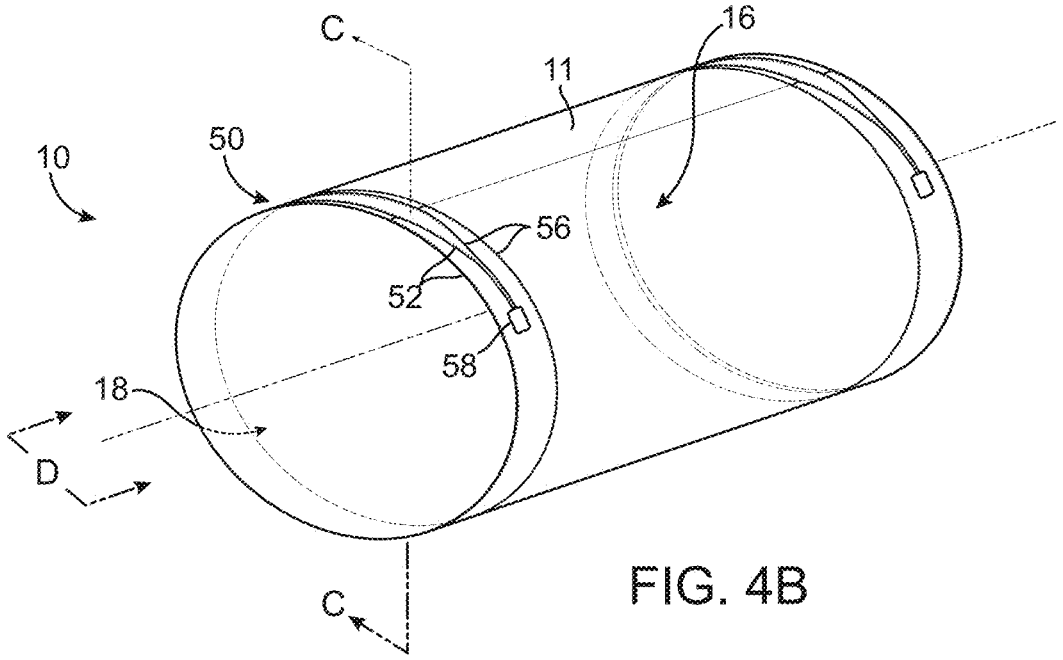
Figure 4C:
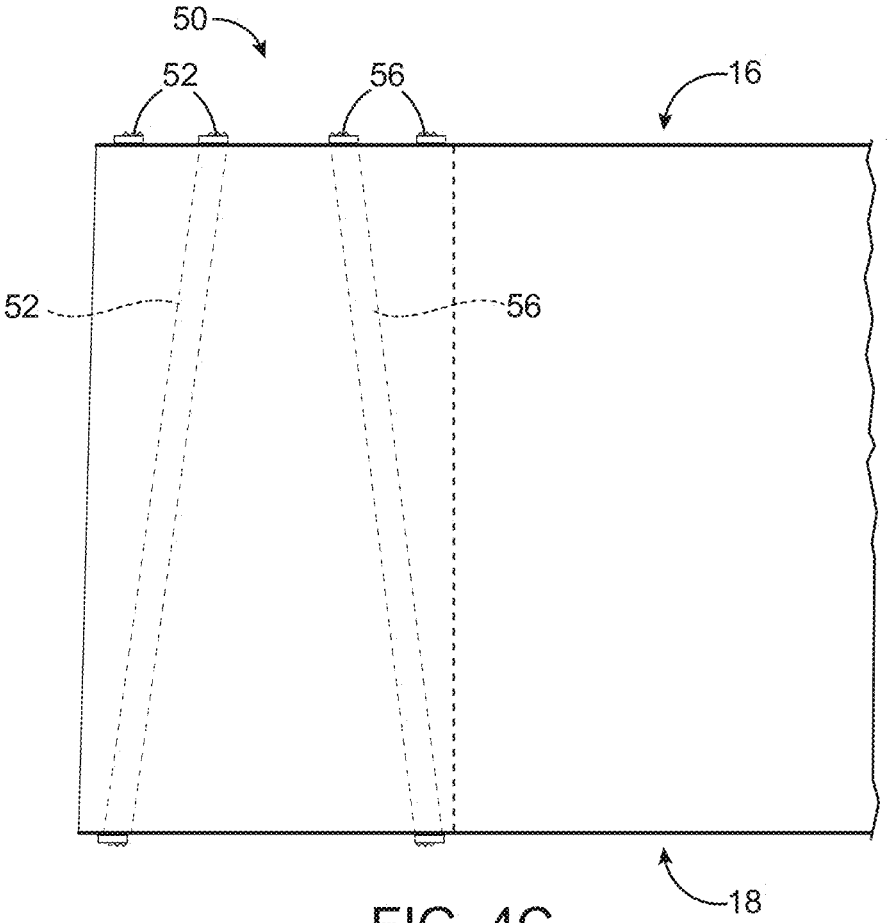
Figure 4D:
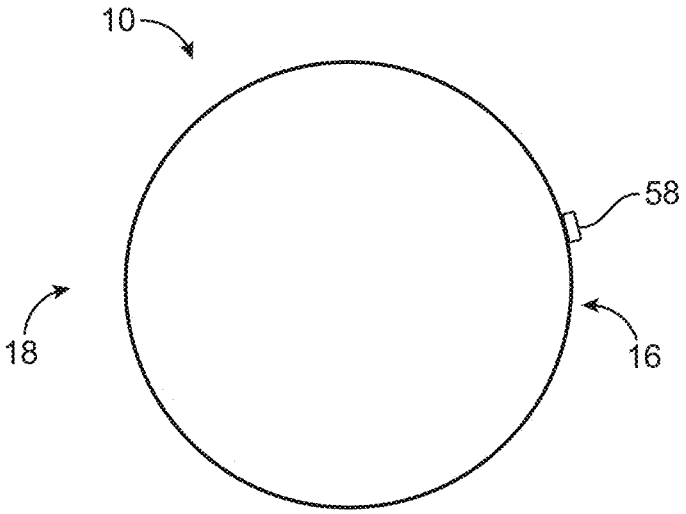
Figure 5A:
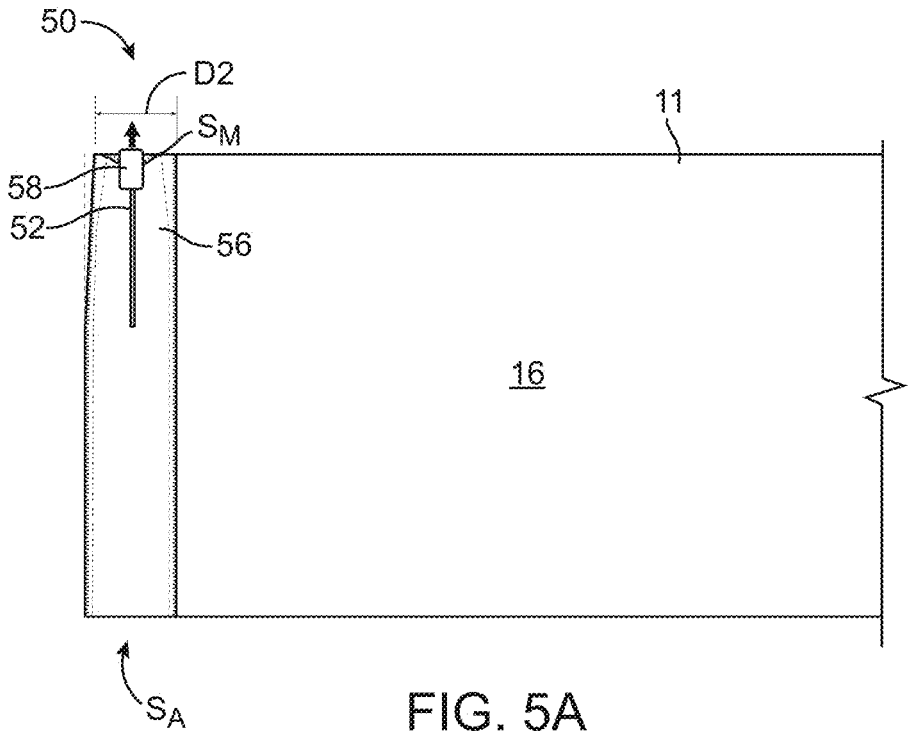
FIGS. 5A-5D show, from the same perspectives provided in FIGS. 4A-4D, respectively, the gathering element of the volume-adjustable cover in a partially gathered arrangement, in which the gathering element defines a first pleat parallel to a length of the gathering element and transverse to a length of the volume-adjustable cover.
Figure 5B:
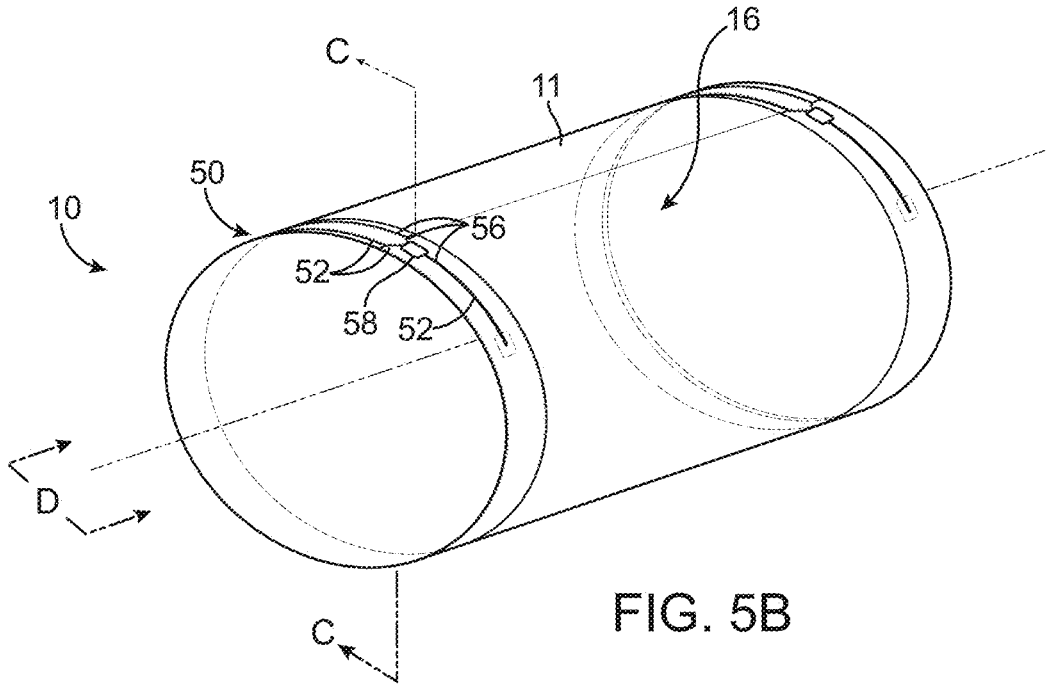
Figure 5C:
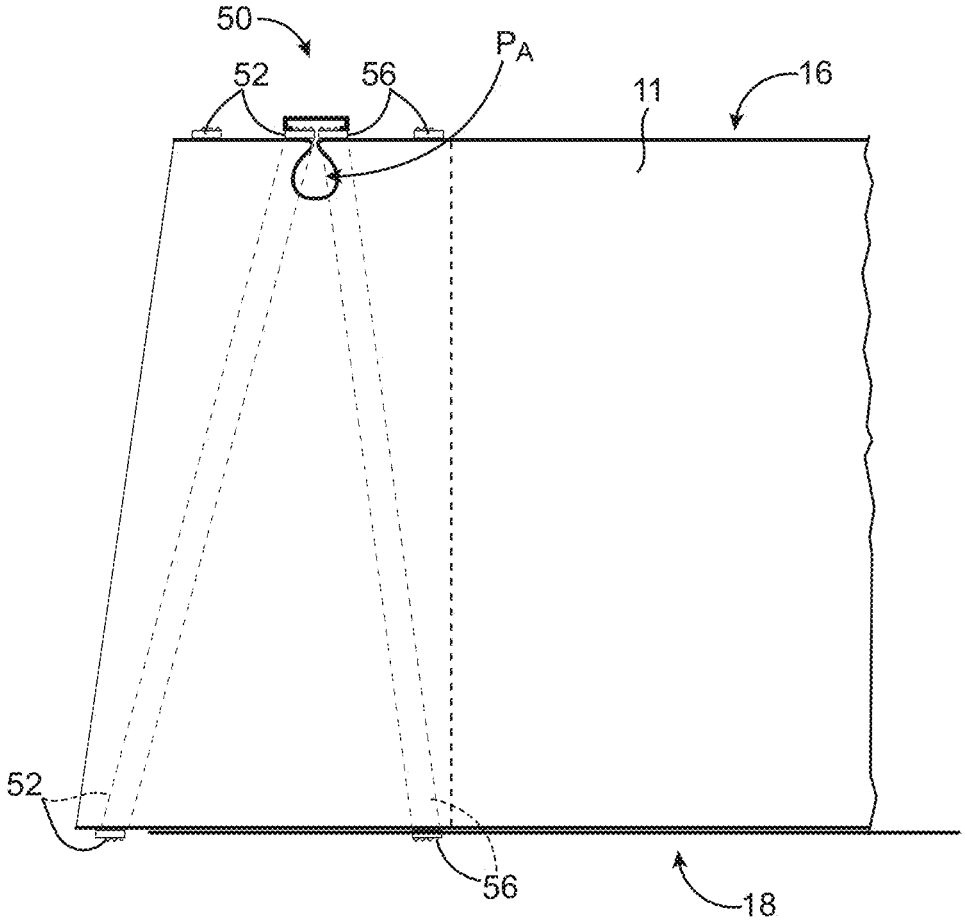
Figure 5D:
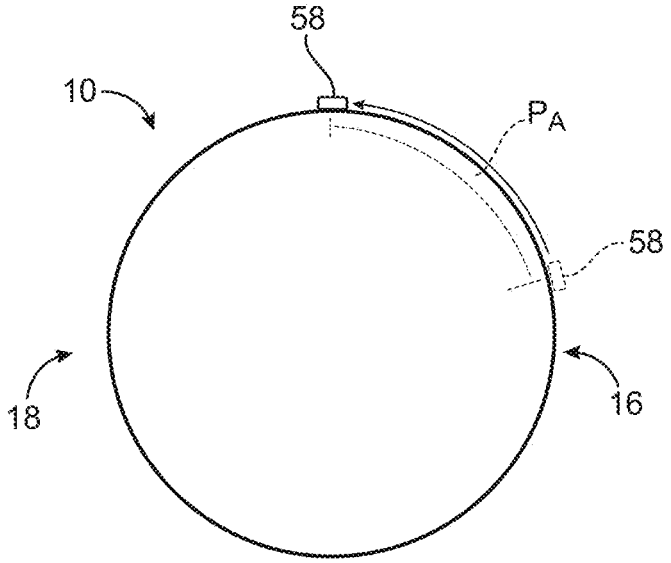
Figure 6A:
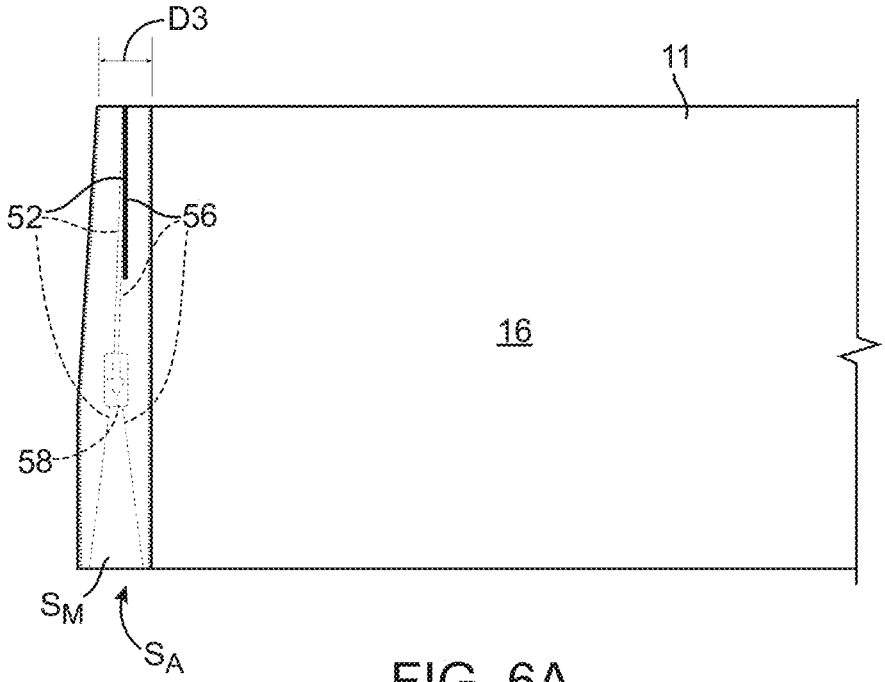
FIGS. 6A-6D show, from the same perspectives provided in FIGS. 4A-4D, respectively, the gathering element of the volume-adjustable cover in a further gathered arrangement, in which the gathering element defines a second pleat parallel to the length of the gathering element and transverse to the length of the volume-adjustable cover.
Figure 6B:
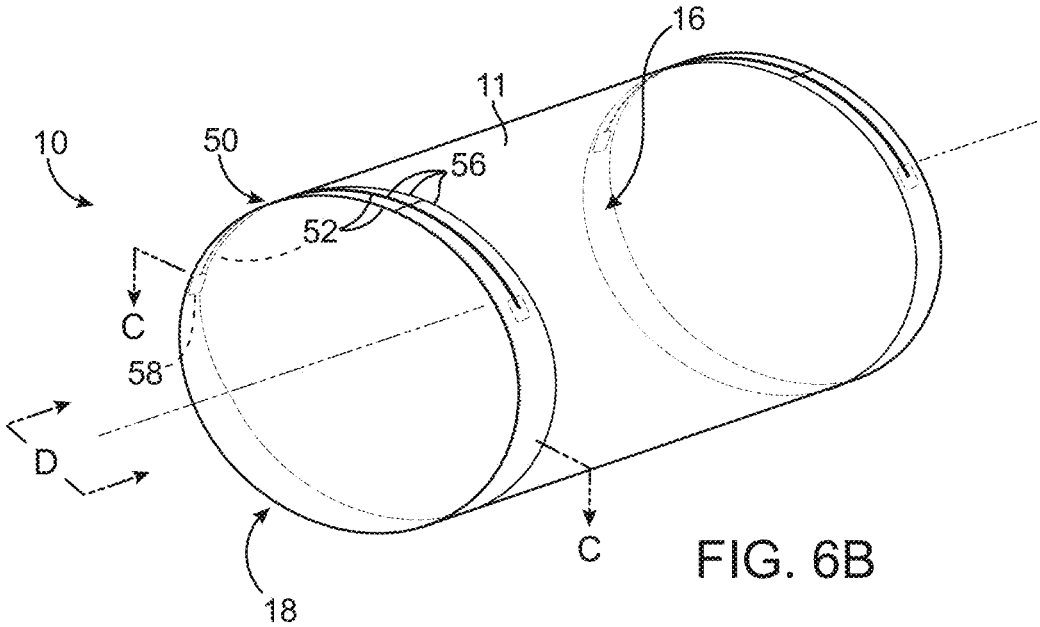
Figure 6C:
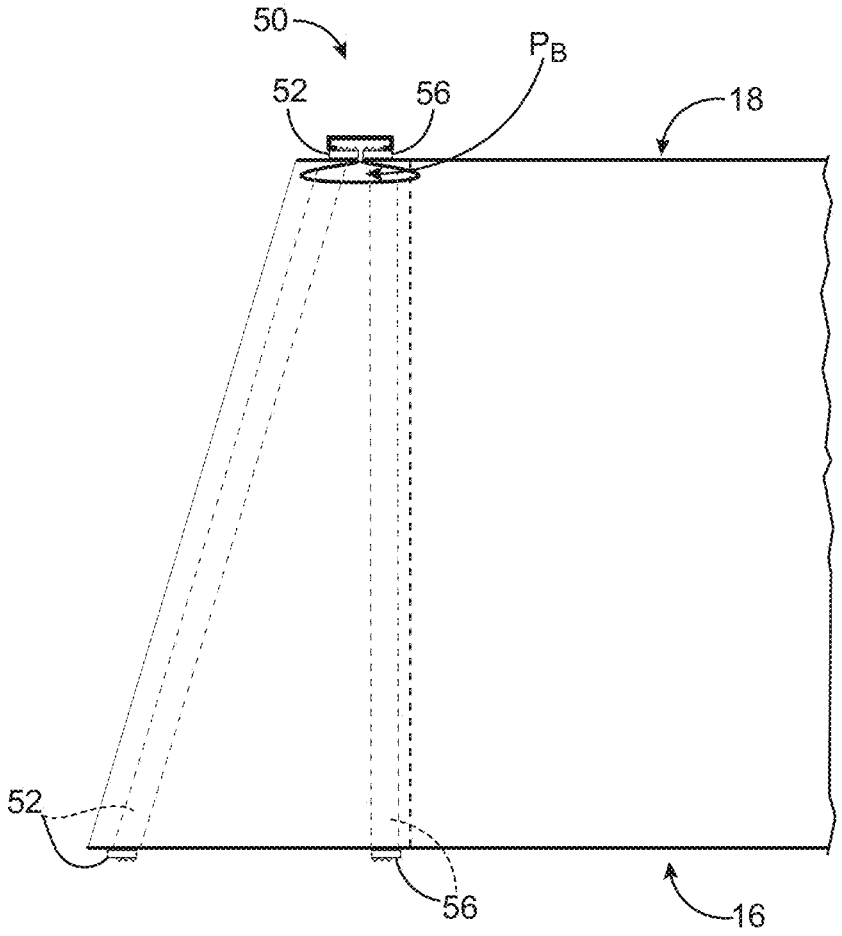
Figure 6D:
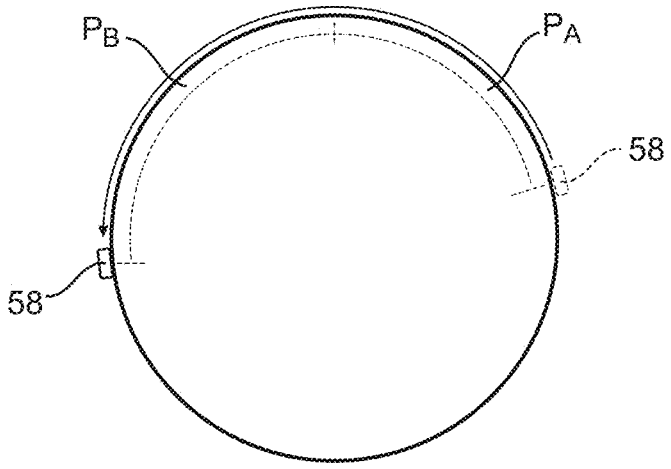
Figure 7A:
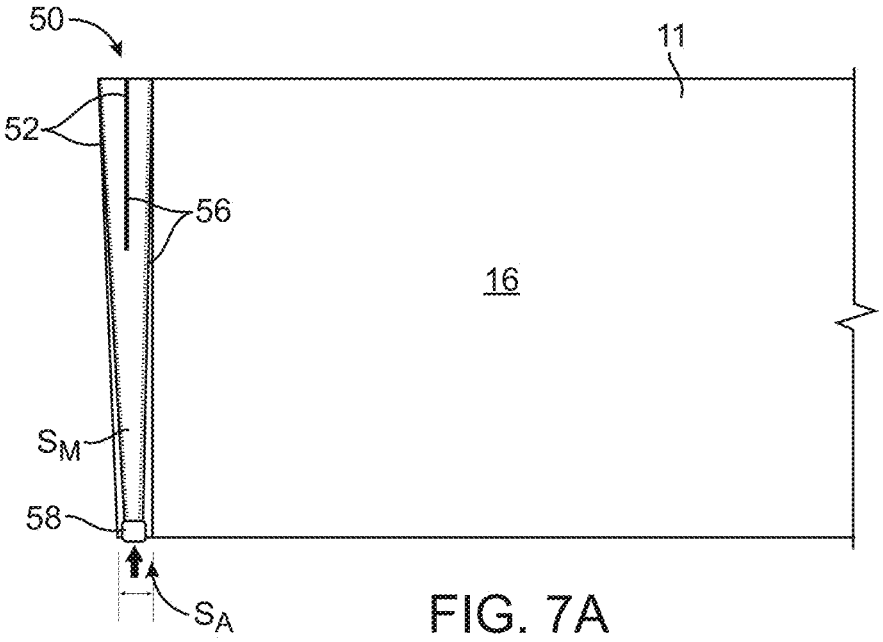
FIGS. 7A-7D show, from the same perspectives provided in FIGS. 4A-4D, respectively, the gathering element of the volume-adjustable cover in an even further gathered arrangement, in which the second pleats defined by the gathering element is further elongated.
Figure 7B:
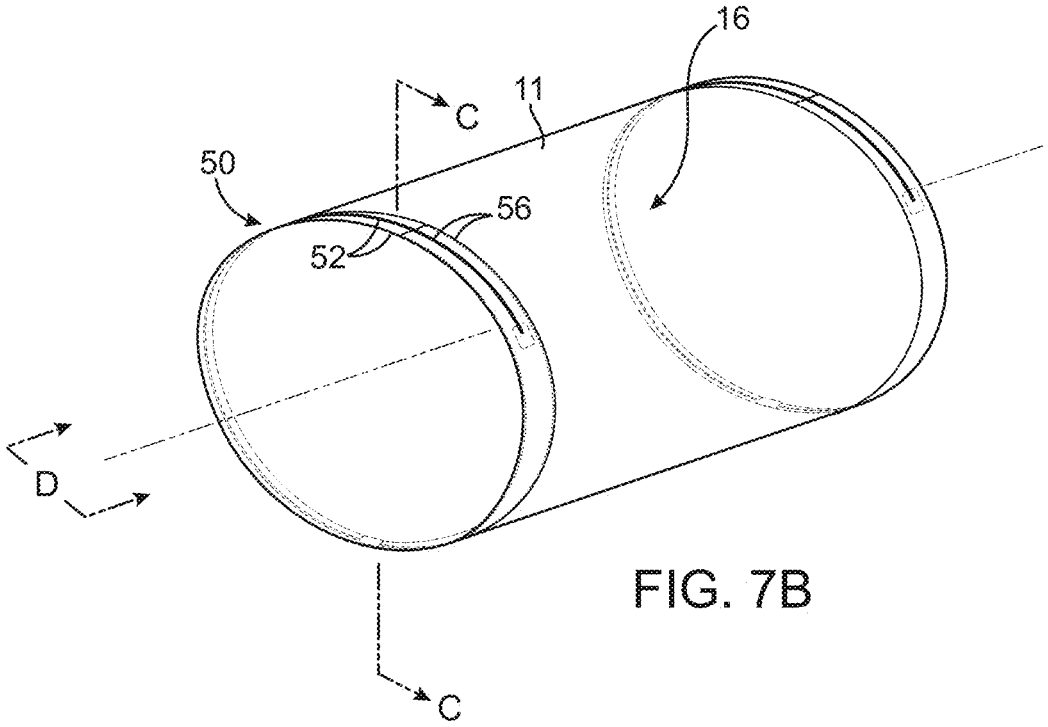
Figure 7C:
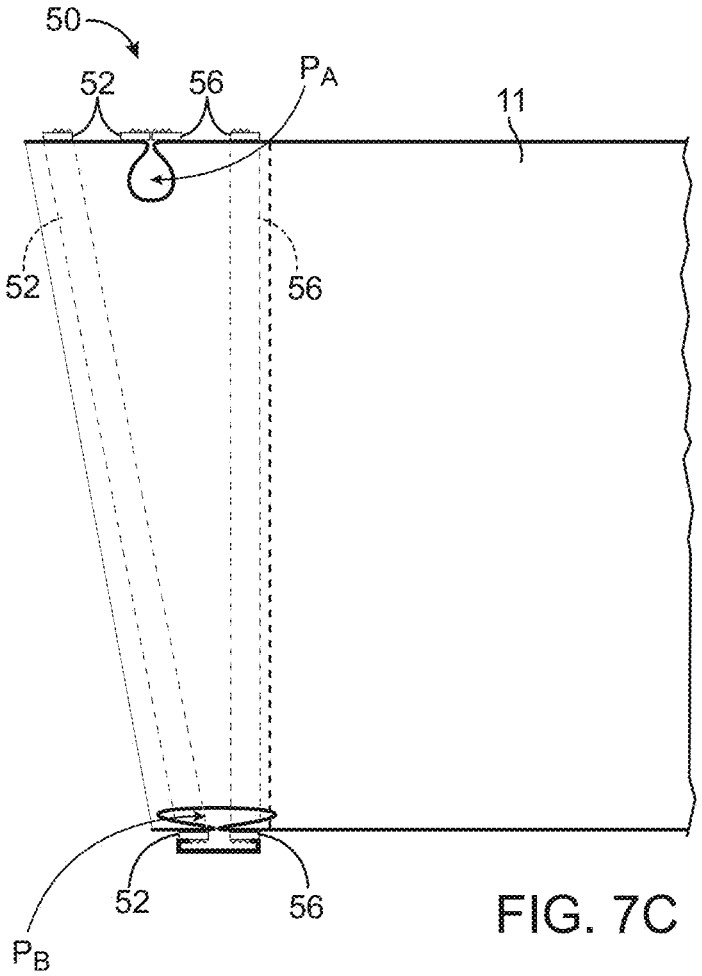
Figure 7D:
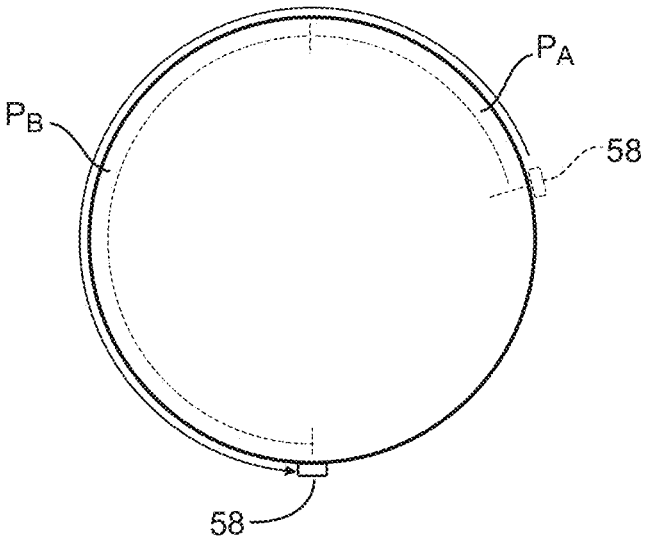

In FIG. 2D, the fastening element 58 has been advanced slightly along the length of the gathering element 50, pulling portions of the engagement features 52 and 56 together and placing the gathering element 50 in a slightly gathered arrangement. With even slight gathering, the width of the adjustment region $S_A$, or at least a portion of the adjustment region $S_A$, is decreased to the distance D2 shown in FIG. 2D.

Figure 2E:
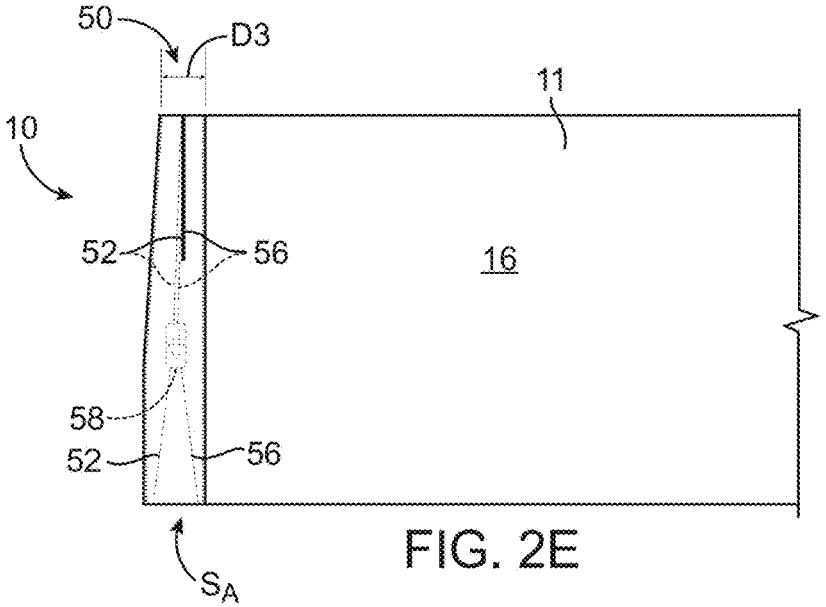

In FIG. 2E, the fastening element 58 has been advanced even further, from a location on the first side 16 of the body 11 of the volume-adjustable cover 10 to a location on the opposite, second side 18 (FIGS. 2A and 2B) of the body 11 of the volume-adjustable cover 10. With such advancement, additional portions of the engagement features 52 and 56 have been pulled together, further decreasing the width of the adjustment region $S_A$ to the distance D3 shown in FIG. 2E.

Figure 2F:
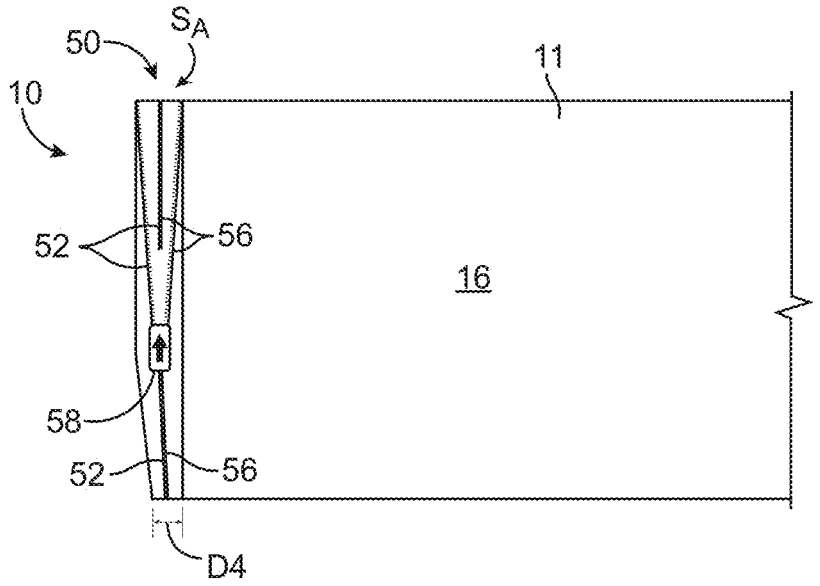

With continued advancement of the fastening element 58 along the length of the gathering element 50, as illustrated by FIG. 2F, additional portions of the engagement features 52 and 56 are brought together and engage one another, even further decreasing the width of the adjustment region $S_A$. As shown in FIG. 2F, the fastening element 58 has been advanced to a location on the first side 16 of the body 11 of the volume-adjustable cover 10. At that location, the width of the adjustment region $S_A$ along part of a length of the adjustment region $S_A$ has been reduced to the distance D4 shown in FIG. 2F.

Figure 2G:
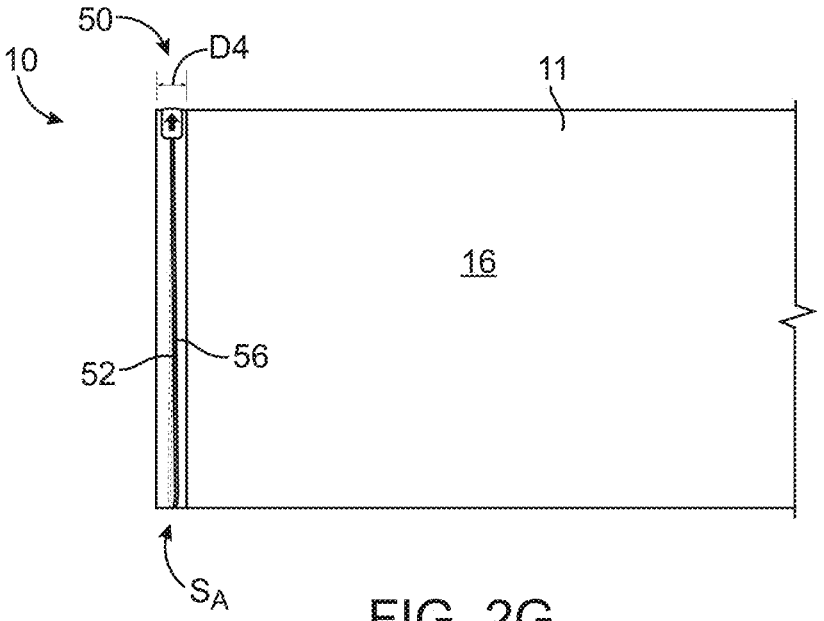

FIG. 2G shows the gathering element 50 in a fully gathered arrangement. In the fully gathered arrangements, the engagement features 52 and 56 have been brought together along their entire lengths and the width of the adjustment region $S_A$ has been minimized to the distance D4 along the entire length of the adjustment region $S_A$.

FIGS. 4A-4D and 9A provide various views of a cushion 100 that includes a volume-adjustable cover 10 with each of its gathering elements 50 in the relaxed arrangement of FIGS. 2A-2C. In the relaxed arrangement, the engaging features 52 and 56 of each gathering element 50 are substantially disengaged from each other. As a non-limiting example, in embodiments where the gathering element 50 comprises a zipper, the two sides of the zipper may engage one another at their ends, but be disengaged from each other at all other locations along the length of the zipper. Since the engaging features 52 and 56 of each gathering element 50 are substantially disengaged from each other in the relaxed arrangement, the edges 51 and 55 of the adjustment region $S_A$ of the surface S of the body 11 of the volume-adjustable cover 10, along which the engaging features 52 and 56 of the gathering element 50 are positioned, may be spaced as far apart from one another as the distance across the adjustment region $S_A$, or the material $S_M$ between the edges 51 and 55, will allow. Thus, when each gathering element 50 is in the relaxed arrangement, the length L of the body 11 of the volume-adjustable cover 10 and the volume of the receptacle 40 of the volume-adjustable cover 10 may be maximized and the limits the volume-adjustable cover 10 places on the ability of the cushioning material of a cushioning element 60 within the receptacle 40 of the volume-adjustable cover 10 may be minimized.

A gathering element 50 of the volume-adjustable cover 10 may be placed into a partially gathered arrangement by pulling corresponding engaging features 52 and 56 or corresponding portions of the engaging features 52 and 56 together and causing one or both of the engaging feature 52 and the engaging feature 56 to engage, or couple to, the other, as depicted by FIGS. 5A-5D, 6A-6D, 7A-7D, and 9B. From FIGS. 5A-5D to FIGS. 6A-6D to FIGS. 7A-7D, the gathering elements 50 are in different partially gathered arrangements. More specifically, FIGS. 5A-5D provide additional views of the gathering element in the slightly gathered arrangement shown in FIG. 2D, FIGS. 6A-6D provide additional views of the gathering element in the further gathered arrangement shown in FIG. 2E, and FIGS. 7A-7D provide additional views of the even further gathered arrangement shown in FIG. 2F. In embodiments where the gathering element 50 comprises a zipper, the gathering element 50 may be placed into a partially gathered arrangement by partially zipping the zipper. As the corresponding engaging features 52 and 56 or corresponding portions of the engaging features 52 and 56 are pulled together and coupled, corresponding portions of the edges 51 and 55, respectively, of the adjustment region $S_A$ are pulled toward one another. As those portions of the edges 51 and 55 are pulled toward one another, material $S_M$ of the portion of the adjustment region $S_A$ between those portions of the edges 51 and 55 gathers. By partially gathering the material $S_M$ of the adjustment region $S_A$, the length L of the body 11 of the volume-adjustable cover 10 and the volume of the receptacle 40 of the volume-adjustable cover 10 decreases and the extent to which the volume-adjustable cover 10 limits migration of the cushioning material 61 (FIGS. 10A-11F) of a cushioning element 60 (FIGS. 10A-11F) within the receptacle 40 (FIG. 1) of the volume-adjustable cover 10 (FIG. 1) increases.

As shown in FIGS. 5A-5D, as the fastening element 58 is advanced to a first position along a length of the gathering element 50, portions of the engagement features 52 and 56 are brought together in a manner that a first pleat is formed at a first region $P_A$ of the adjustment region $S_A$ (FIG. 2D) between the engagement features 52 and 56. By advancing the fastening element 58 further to a second position, such as that shown in FIGS. 6A-6D, additional portions of the engagement features 52 and 56 are brought together, forming a second pleat in a portion of a second region $P_B$ of the adjustment region $S_A$ (FIG. 2E) between the engagement features 52 and 56. Further advancement of the fastening element 58 to the third position shown in FIGS. 7A-7D brings even further portions of the engagement features 52 and 56 together, extending a length of the second pleat in the second region $P_B$ of the adjustment region $S_A$ (FIG. 2F) (e.g., along an entire length of the second region $P_B$, etc.).

It should be understood that progressively coupling corresponding portions of the engaging features 52 and 56 and, thus, progressively pulling edges 51 and 55 (FIG. 1) of the adjustment region $S_A$ together progressively, as depicted from FIGS. 4A-4D to FIGS. 5A-5D to FIGS. 6A-6D to FIGS. 7A-7D to FIGS. 8A-8D decreases the length L of the body 11 of the volume-adjustable cover 10, progressively decreases the volume of the receptacle 40 of the volume-adjustable cover 10, and progressively increases the limits the volume-adjustable cover 10 places on migration of the cushioning material of the cushioning element 60 within the receptacle 40 of the volume-adjustable cover 10 away from an object supported by the volume-adjustable cover 10 and the cushioning element 60.

FIGS. 8A-8D and 9C provide additional views of the fully gathered arrangement of the gathering element 50 shown in FIG. 2G. In the fully gathered arrangement, the engaging features 52 and 56 of the gathering element 50 are coupled to one another along the entire length of the gathering element 50, ensuring that the edges 51 and 55 (FIG. 1) on opposite sides of the corresponding adjustment region $S_A$ of the surface S of the body 11 of the volume-adjustable cover 10 are pulled together along the entire length of the adjustment region $S_A$. While both gathering elements 50 are in the gathered arrangement, the length L of the volume-adjustable cover 10 is minimized, the volume of the receptacle 40 of the volume-adjustable cover 10 is minimized, and the extent to which the volume-adjustable cover 10 limits migration of the cushioning material 61 (FIGS. 10A-11F) of a cushioning element 60 (FIGS. 10A-11F) within the receptacle 40 (FIG. 1) of the volume-adjustable cover 10 away from an object supported by the volume-adjustable cover 10 and the cushioning element 60 is maximized.

Figure 8A:
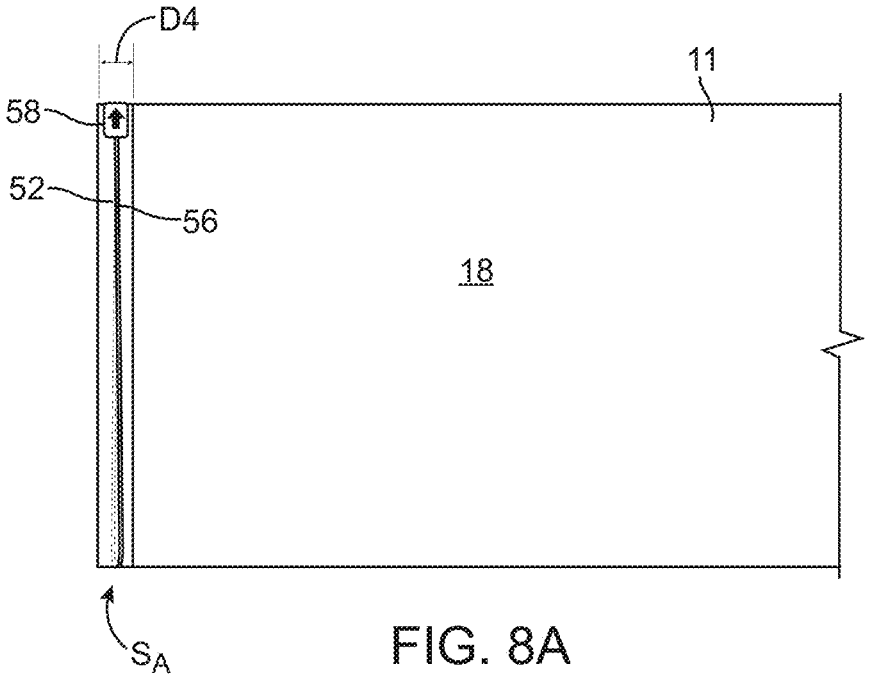
FIGS. 8A-8D show, from the same perspectives provided in FIGS. 4A-4D, respectively, the gathering element of the volume-adjustable cover in a fully gathered arrangement, in which the gathering element defines a third pleat parallel to the length of the gathering element and transverse to the length of the volume-adjustable cover, with the third pleat surrounding, or compounding, at least a portion of the first pleat.
Figure 8B:
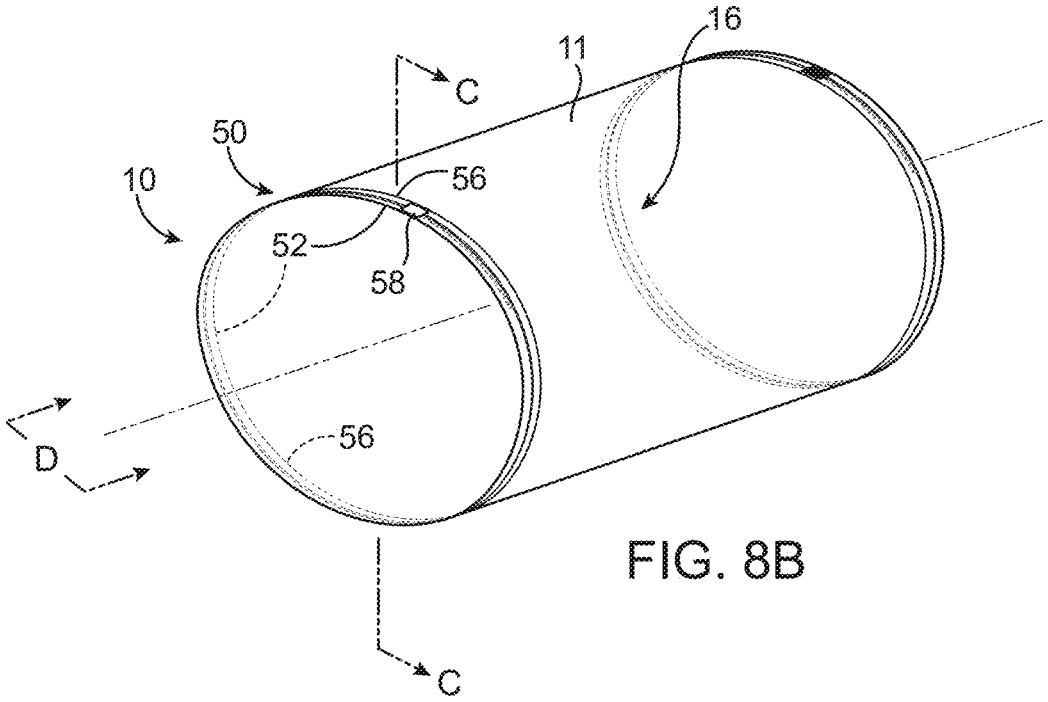
Figure 8C:
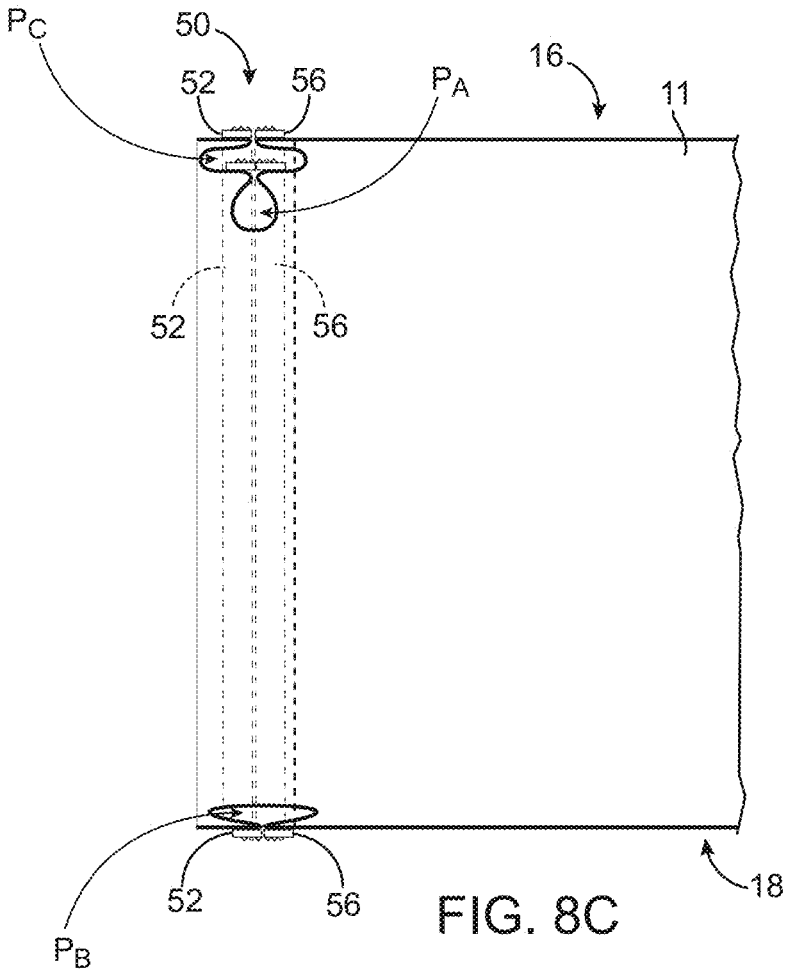
Figure 8D:
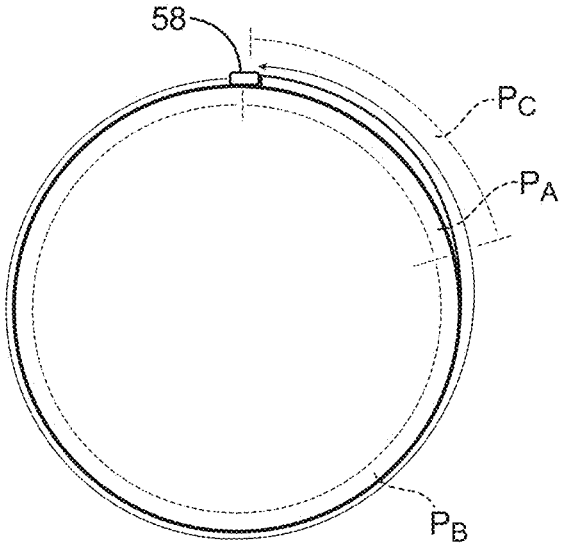
Figure 9A:
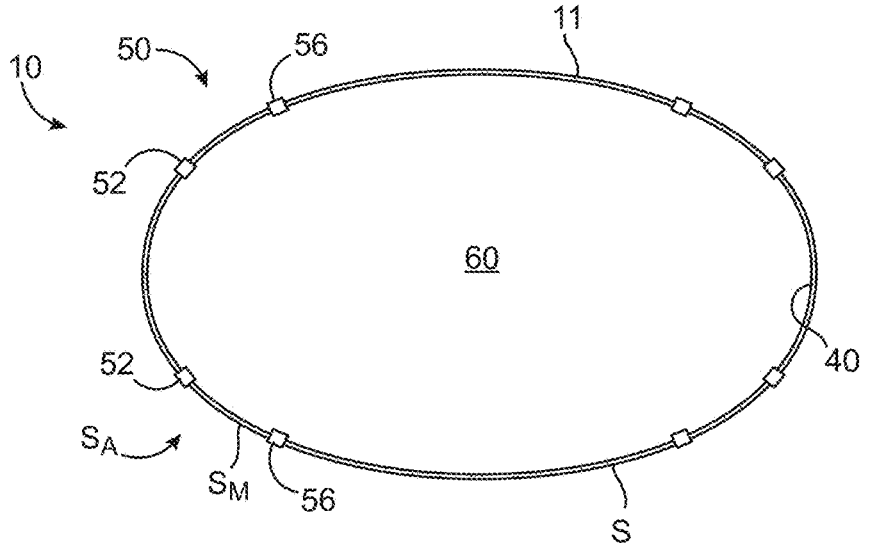
FIGS. 9A, 9B, and 9C are cross-sectional representations of a volume-adjustable cover, respectively depicting the gathering element in the relaxed arrangement of FIGS. 4A-4D, the partially gathered arrangement of FIGS. 5A-5D, and the fully gathered arrangement of FIGS. 8A-8D.
Figure 9B:
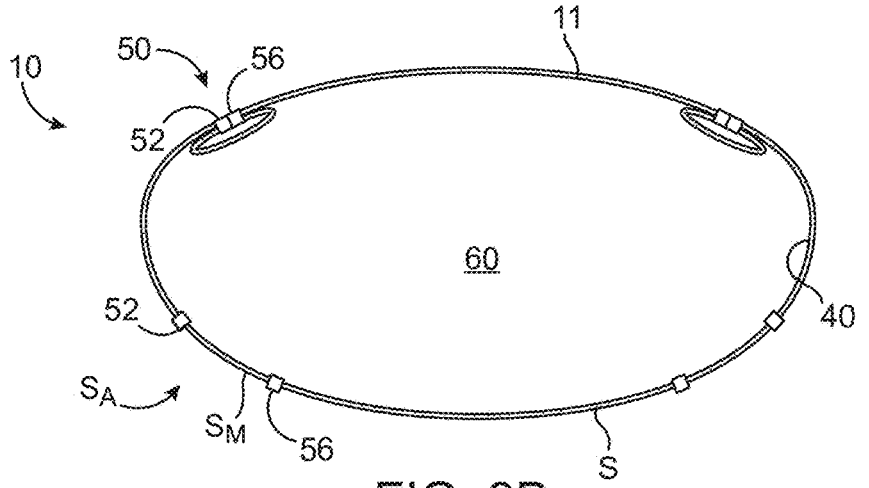
Figure 9C:
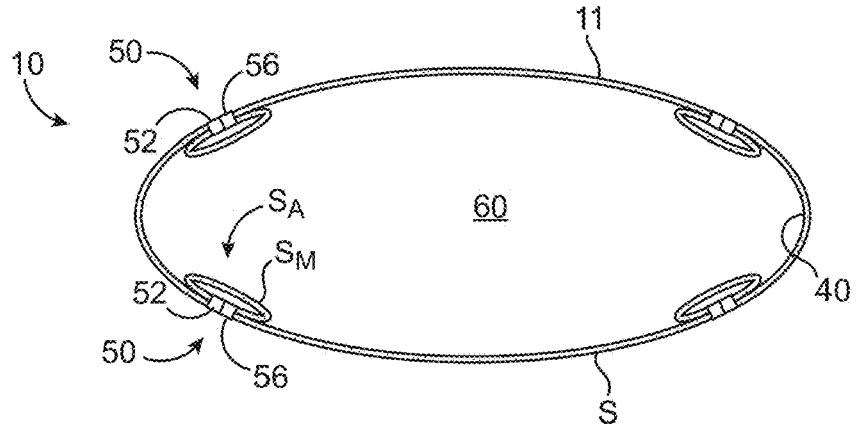

When the fastening element 58 has been fully advanced and the engagement features 52 and 56 have been brought together and engaged each other along an entire length of the gathering element 50, as shown in FIGS. 8A-8D, a third pleat is formed along a third region $P_C$ of the adjustment region $S_A$ (FIG. 2G). Notably, since the third region $P_C$ and the first region $P_A$ are at least partially coincident, or adjacent to each other along at least part of the length of the adjustment region $S_A$, the third pleat may be located over, or compounded with, the first pleat, as shown in FIG. 8C.

Variations on the arrangements of gathering elements 50 shown in FIGS. 2A-8D are also possible and, thus, may also be used. Such variations may include macro adjustment of one or both gathering elements 50 (e.g., opening or closing a zipper a centimeter or more, a distance of five teeth or more, etc.) or micro adjustment of one or both gathering elements 50 (e.g., opening or closing a zipper less than a centimeter, a distance of fewer than five teeth, one tooth at a time, etc.). As an example, one gathering element 50 may be placed in a relaxed arrangement while the other gathering element 50 may be placed in an at least partially gathered arrangement. As another example, one gathering element 50 may be placed in an at least partially gathered arrangement while the other gathering element 50 may be placed in a gathered arrangement. As will become further apparent hereinafter, the arrangement of each gathering element 50 of a volume-adjustable cover 10 may be tailored to enable a cushion 100 that includes the volume-adjustable cover 50 to support an object (e.g., an individual's head, an individual's body, etc.) in a desired manner. Tailoring the arrangement of each gathering element 50 may accommodate one or more variables, such as the shape of the object, the environment in which the cushion 100 is being used, the axial orientation of the object, and the desired longitudinal orientation of the object.

Figure 10A:
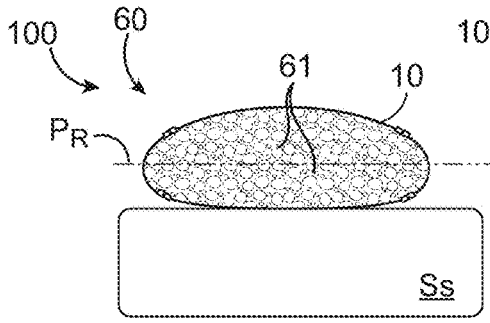
FIG. 10A is a cross-sectional representation taken along a length of a cushioning element with a volume-adjustable cover thereon in a fully gathered arrangement and without an object thereon.
Figure 11A:
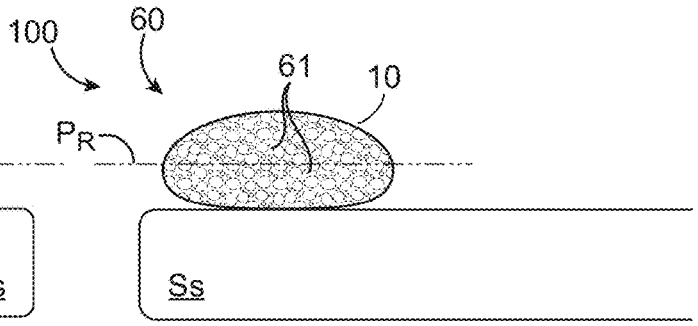
FIG. 11A is a cross-sectional representation taken along a depth of the cushioning element shown in FIG. 10A.
Figure 10B:
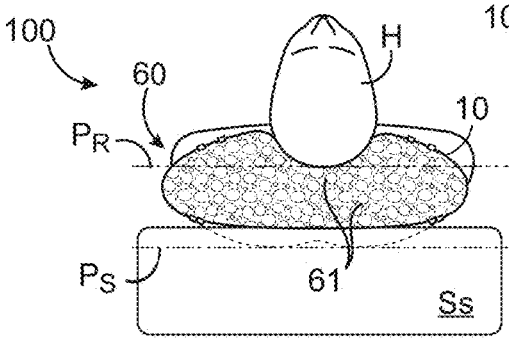
FIGS. 10B and 11B are cross-sectional representations corresponding to FIGS. 10A and 11A, respectively, showing the volume-adjustable cover in a partially gathered arrangement, with the cushioning element supporting an object (e.g., an individual's head)
Figure 11B:
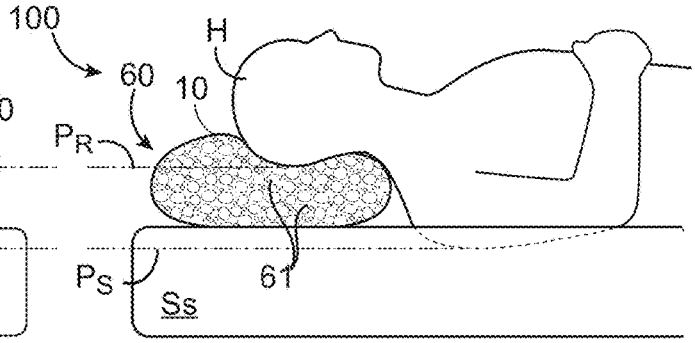
Figure 10C:
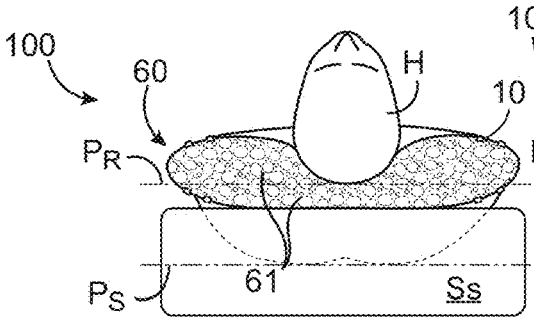
FIGS. 10C and 11C are cross-sectional representations corresponding to FIGS. 10A and 11A, respectively, showing the volume-adjustable cover in a relaxed arrangement, with the cushioning element supporting an object (e.g., an individual's head)
Figure 11C:
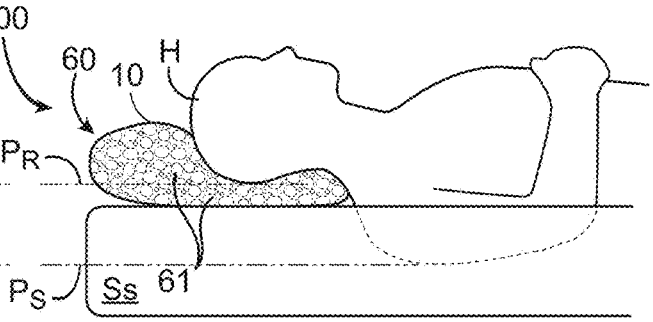

FIGS. 10A-10C and 11A-11C illustrate how a volume-adjustable cover 10 can be used to limit the extent to which cushioning material 61 (e.g., an infill material, etc.) of a cushioning element 60 within the volume-adjustable cover 10 migrates and to control the elevation at which a cushion supports an object, such as an individual's head. FIGS. 10A-10C provide cross-sectional representations of the cushioning element 60 through the length of the cushioning element 60. FIGS. 11A-11C provide cross-sectional representations of the cushioning element 60 through its depth (i.e., from its front edge to its rear edge). In FIGS. 10A and 11A, the cushioning element 60 and its cushioning material 61 have been fluffed, and it does not support an object. A reference plane $P_R$ that extends through the cushioning element 60 represents a minimum height the cushioning element 60 will support a particular object, such as an individual's head, over a surface S on which the cushioning element 60 has been placed.

When an object, such as an individual's head H, is placed on the cushioning element 60, as depicted by FIGS. 10B and 10B, the cushioning material 61 of the cushioning element 60 compresses beneath the object. The object may be supported at an elevation of the reference plane $P_R$ through the cushioning element 60. Some of the weight of the object (e.g., the weight of the individual's head H, the weight of the individual's body, etc.) may deform a support surface $S_S$ upon which the cushion 100 rests. Without limitation, portions of the support surface $S_S$ may be deformed to the support plane $P_S$ shown in FIGS. 10A-11C.

The location of the reference plane $P_R$ may be adjusted by limiting the extent to which migration of the cushioning material 61 of the cushioning element 60 is limited; for example, by adjusting one or more gathering elements 50 (FIGS. 1-9C) of the volume-adjustable cover 10. As depicted by FIGS. 10C and 11C, the volume-adjustable cover 10 may be adjusted in a manner that lowers, or decreases, the elevation of the reference plane $P_R$. Similarly, the elevation of the reference plane $P_R$ may be raised, or increased.

Over time (e.g., during a single use of the cushion 100, with repeated use of the cushion 100, etc.), in embodiments where the cushioning material comprises an infill material, the cushioning material 61 of the cushioning element 60 migrate away from an object supported by the cushioning element 60. The rate at which the cushioning material 61 migrates over time may depend upon any of a variety of factors, including, without limitation, the type of infill material (or types of infill materials where mixtures or blends of infill materials are employed), the particle size(s) of the infill material (e.g., average particle size, range of particle sizes, etc.), the shape(s) of the particles of the infill material, among any of a variety of other factors. Such migration may include migration of cushioning material 61 to the sides of the object, as well as migration of cushioning material 61 beneath the object. As cushioning material 61 migrates from beneath the object, the elevation of the reference plane $P_R$ at which the cushioning element 60 supports the object decreases. In embodiments where the cushioning element 60 comprises a pillow and the object supported by the cushioning element 60 is an individual's head H, the elevation of the reference plane $P_R$ at which the cushioning element 60 supports the individual's head may decrease over time (e.g., as the individual rests, overnight, etc.). Changes in the elevation of the individual's head may affect the shape of his or her spinal column SC, which may affect his or her ability to achieve a restful state of sleep.

Figure 10D:
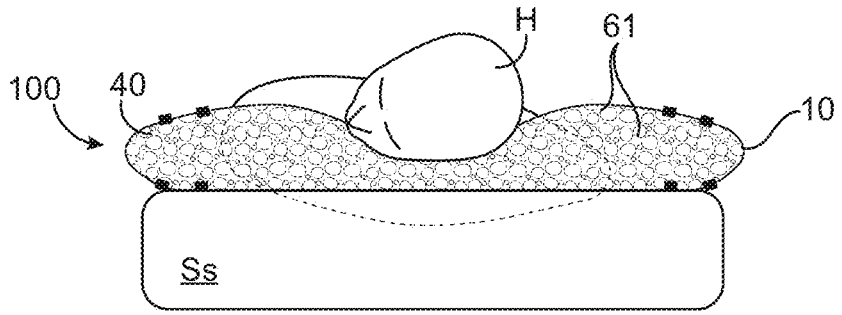
FIGS. 10D and 11D are cross-sectional representations corresponding to FIGS. 10A and 11A, respectively, showing how the cushion with the volume-adjustable cover in the relaxed arrangement may be used to support an individual's head as the individual sleeps on his or her chest and stomach.
Figure 11D:
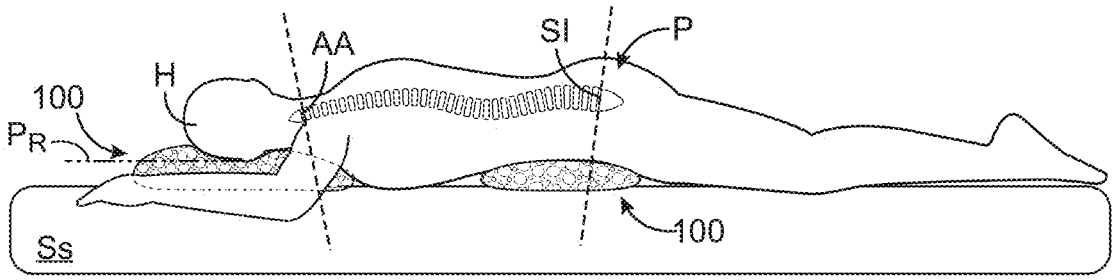

FIGS. 10D and 11D are cross-sectional representations showing a cushioning element 60 within a receptacle 40 of a volume-adjustable cover 10. The volume-adjustable cover 10 has a length that is longer than a length of the cushioning element 60 and a volume that is larger than a volume of the cushioning element 60; thus, the volume-adjustable cover 10 fits loosely over the cushioning element 60. The gathering elements 50 of the volume-adjustable cover 10 are in the relaxed arrangements depicted by FIGS. 2A-2C, 4A-4D, and 9A. As the volume-adjustable cover 10 and the cushioning element 60 therein support an object, such as the depicted head H, over a prolonged duration of time, the cushioning material 61 of the cushioning element 60 migrates away from the object. As depicted by FIGS. 10D and 11D, the extent to which the cushioning material 61 has migrated is about the same as the extent to which the cushioning material 61 would have migrated away from the object if the cushioning element 60 was not covered by a volume-adjustable cover 10. As illustrated, such an arrangement may be useful for supporting an individual's head H when the individual sleeps on her chest and stomach.

Figure 10E:
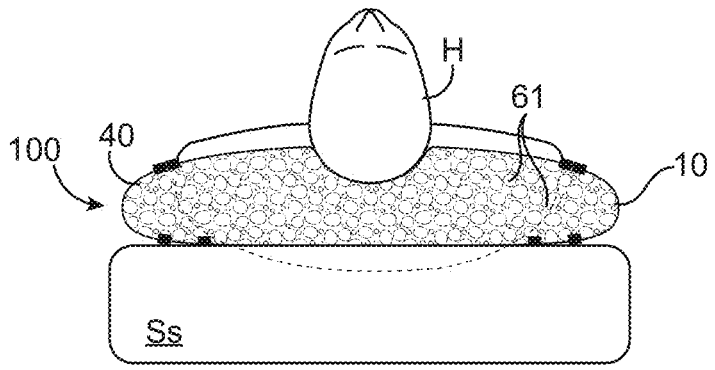
FIGS. 10E and 11E are cross-sectional representations corresponding to FIGS. 10A and 11A, respectively, showing how the cushion with the volume-adjustable cover in a partially gathered arrangement may be used to support an individual's head as the individual sleeps on his or her back.
Figure 10F:
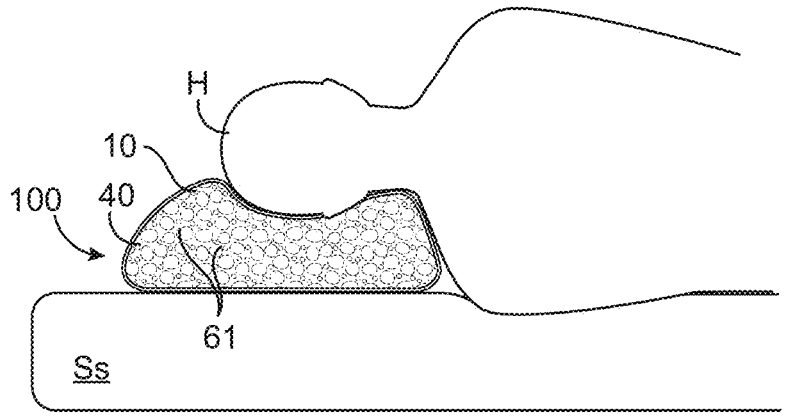
FIGS. 10F and 11F are cross-sectional representations showing how the cushion with the volume-adjustable cover in a partially gathered arrangement or the fully gathered arrangement may be used to support an individual's head as the individual sleeps on his or her side.
Figure 11E:
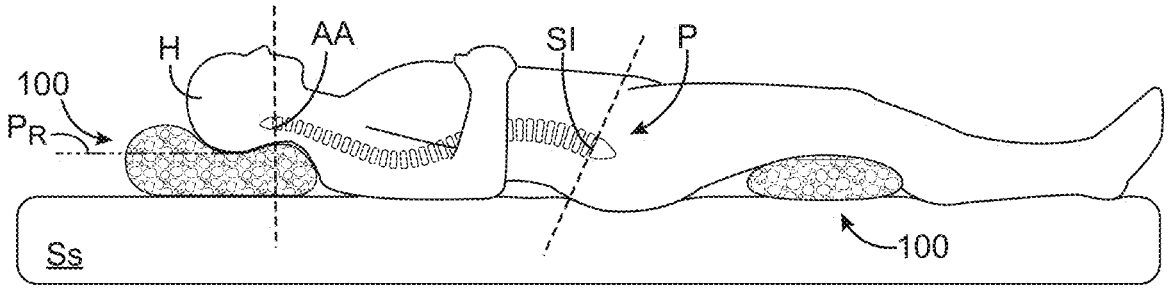
Figure 11F:
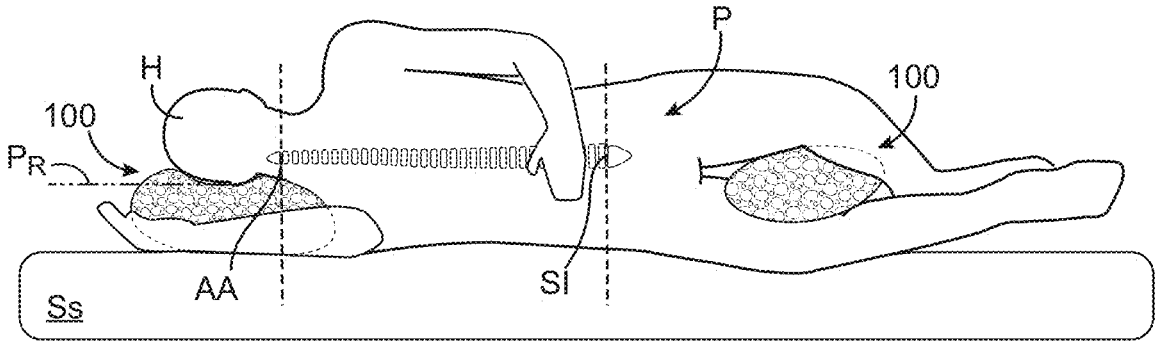
Figures 1, 12A:
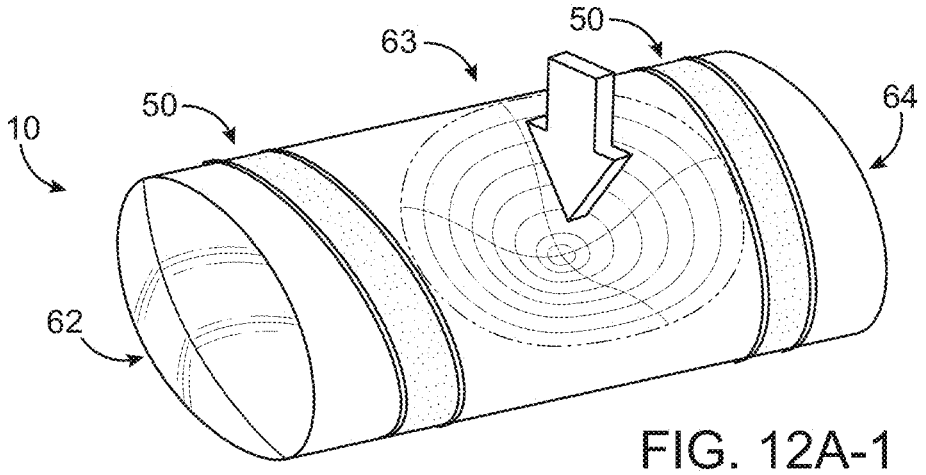
Figures 2, 12A:
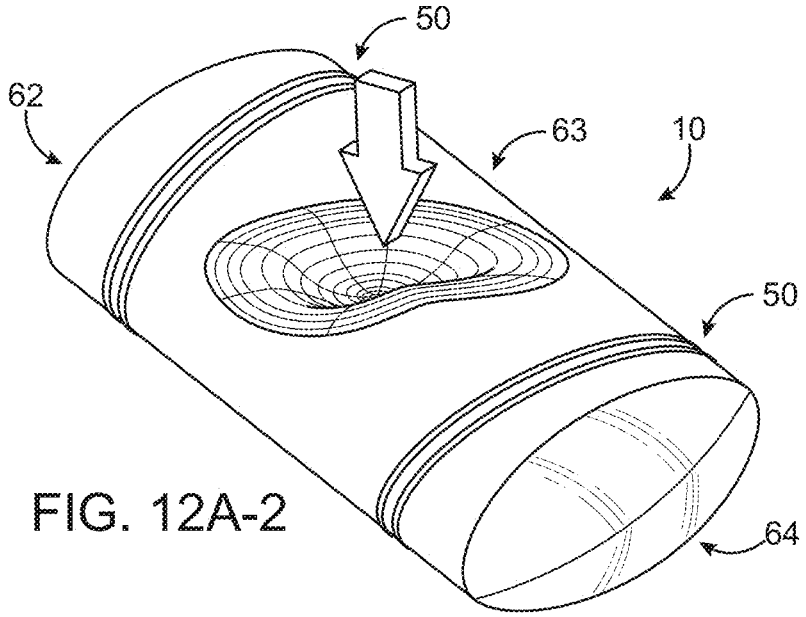
Figures 3, 12A:
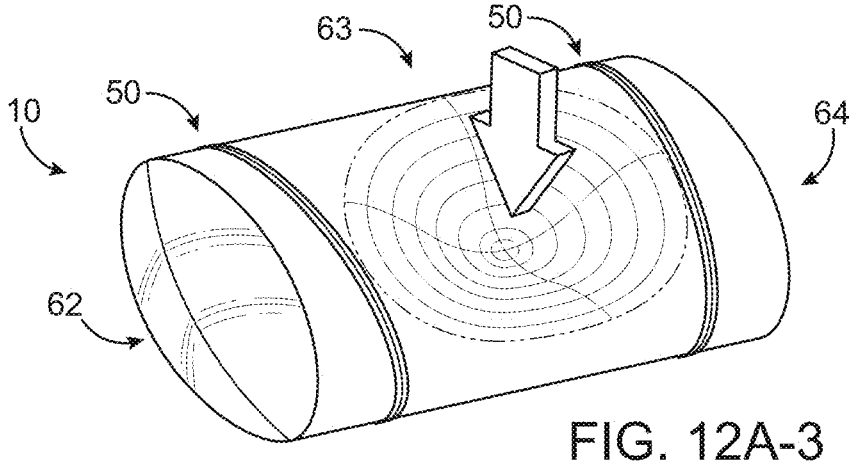
Figures 1, 12B:
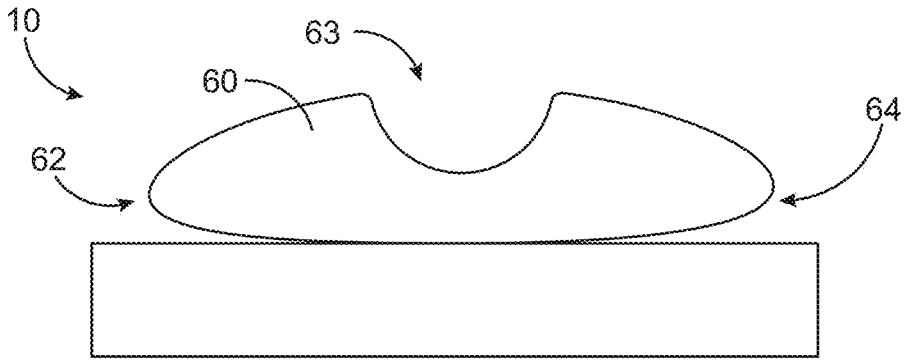
Figures 2, 12B:
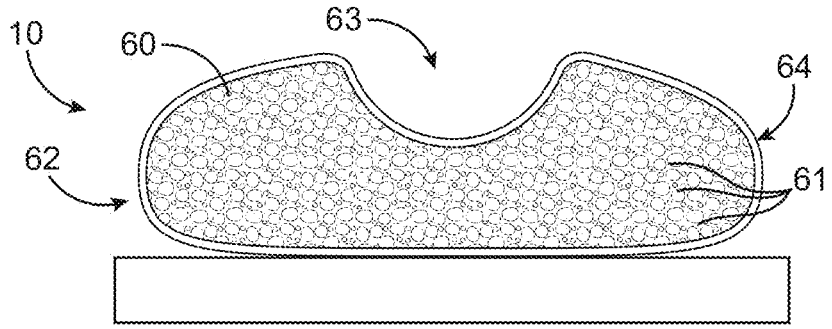
Figures 3, 12B:
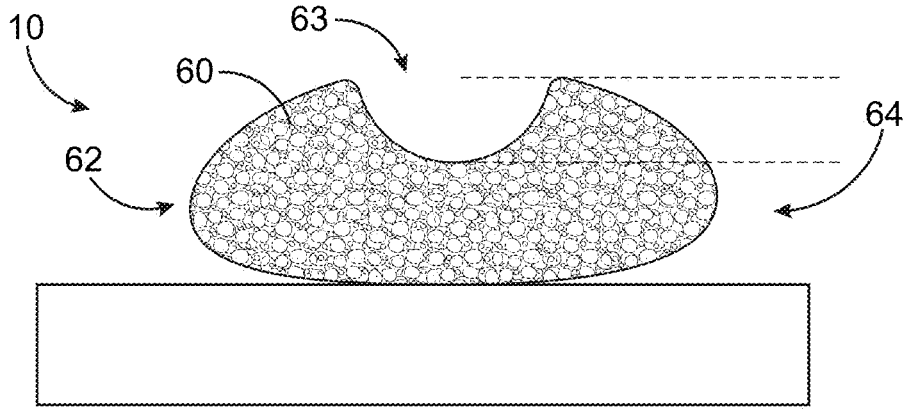

As at least one gathering element 50 of the volume-adjustable cover 10 is placed in a partially gathered arrangement, such as those depicted by FIGS. 2D, 5A-5D, 6A-6D, 7A-7D, and 9B, the length of the volume-adjustable cover 10 decreases, or is shortened. FIGS. 10E and 11E and 10F and 11F show the effects of shortening of the volume-adjustable cover 10 to different lengths that are smaller than a length of the cushioning element 60 within the volume-adjustable cover 10 may limit the extent to which cushioning material 61 within the cushioning element 60 may migrate away from an object, such as an individual's head H, supported by the volume-adjustable cover 10 and the cushioning element 60. In FIGS. 10E and 11E, the cushion 100 of which the cushioning element 60 and the volume-adjustable cover 10 are a part may be adjusted in a manner that accommodates an individual laying on her back. In FIGS. 10F and 11F, the cushion 100 of which the cushioning element 60 and the volume-adjustable cover 10 are a part may be adjusted in a manner that accommodates an individual laying on her side. In addition, limiting the extent to which the cushioning material 61 may migrate may also adjust the elevation of the reference plane $P_R$, which represents the minimum height the cushioning element 60 will support the object over the support surface $S_S$ on which the cushioning element 60 has been placed. Thus, as shown in FIGS. 11E and 11F, in embodiments where the cushioning element 60 comprises a pillow and the object is an individual's head H, placement of at least one gathering element 50 in a partially gathered arrangement may enable tailoring of the elevation at which the cushioning element 60 will support the head H over the support surface $S_S$ and, thus, the shape of the individual's spinal column SC as he or she sleeps on the surface $S_S$ using the cushioning element 60 and the volume-adjustable cover 10.

As illustrated by FIGS. 12A-1 to 12A-3 and 12B-1 to 12B-3, the extent to which a cushioning element 60 deforms may be controlled by adjusting the length of the volume-adjustable cover 10. For example, the length of the volume-adjustable cover 10 may be shortened while a middle portion 63 of the cushioning element 60 supports an object (not shown). As the length of the volume-adjustable cover 10 decreases, the ends 62 and 64 of the cushioning element 60 and the cushioning material 61 of the ends 62 and 64 may be pushed toward the object. Thus, the volume-adjustable cover 10 may cause the cushioning element 60 to conform, or mold, to the shape of the object. In some embodiments, the volume-adjustable cover 10 may hold the cushioning element 60 in such a conforming shape for a prolonged duration.

Adjustments to the volume-adjustable cover 10, including macro adjustments and/or micro adjustments, may be made while the volume-adjustable cover 10 and the cushioning element 60 therein support part of an individual's body and, thus, while under load of the part of the individual's body. Such adjustments may be made with feedback from the individual, which may be based on the level of comfort experienced by the individual, based on the individual's understanding or opinion of comfort and the type of cushioning and cushioning effect(s) the individual prefers. The individual's feedback may be based on nerve signals relating to the individual's sense of feeling.

The volume-adjustable cover 10 may be adjusted so the volume-adjustable cover 10 and the cushioning element 60 therein position an individual's head and/or spinal column in a manner that affects the individual's ascending reticular activating system (ARAS)—a network within the individual's brainstem that plays a role in regulating the alertness, of arousal, of the brain and, thus, plays an important role in regulating wakefulness and sleep wake transitions. Such adjustment may affect how quickly the individual falls asleep, the duration of the individuals' sleep, as well as the states of sleep experienced by the individual and extents of restfulness and restoration/regeneration that may be achieved as the individual sleeps.

Figure 13:
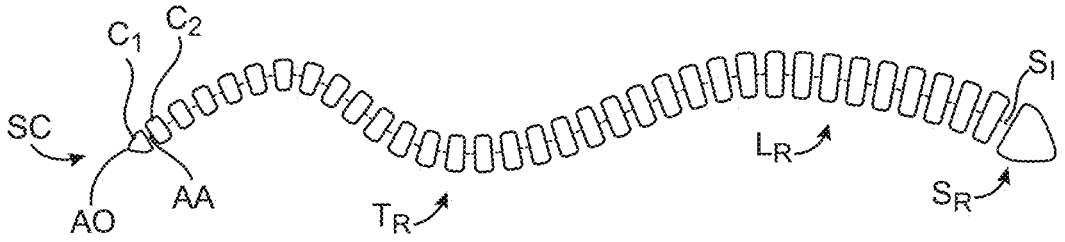
FIG. 13 provides a biomechanical representation of an individual's spinal column, showing vertebra of the spine as rigid elements and intervertebral discs of the spine as elastic elements.

Turning to FIG. 13, the spinal column SC, or spine, of an individual extends from the atlanto-occipital joint AO (i.e., the joint between the skull and the atlas (C1 vertebra)) at the top of the neck to the sacroiliac joint SI at the pelvis. The spinal column SC includes rigid elements (the vertebra) connected to each other via elastic elements (the intervertebral discs), and may be considered to comprise a closed kinematic system, or a closed kinematic chain. The angles at which the atlanto-occipital joint AO orients the individual's head and the SI joint orients the individual's pelvis are at least partially responsible for the curvature of the closed kinematic chain. The positions and/or orientations of any part of the spinal column SC, including, without limitation, the atlanto-occipital joint AO, the atlanto-axial joint AA (the joint between the atlas and the axis (the C2 vertebra), and the sacroiliac joint SI, may affect the shape, or curvature, of the spinal column SC, as may the application of a load to any portion of the spinal column SC.

With continued reference to FIG. 13, as an individual lies flat on a support surface $S_S$, either on his or her back, as shown in FIG. 11E, or on his or her chest and stomach, as shown in FIG. 11D, the positions and/or orientations of the atlanto-axial joint AA and the sacroiliac joint SI may place stress on or otherwise affect the natural curvatures of the lumbar region LR of the spinal column SC (i.e., the lordotic curve), the thoracic region TR and/or sacral region SR of the spinal column SC, the pelvic incidence, the sacral slope, and/or the pelvic tilt. Thus, when an individual uses a pillow P that does not support his or her head H at an appropriate elevation and/or orientation relative to the rest of his or her body, stress may be placed on the individual's spinal column SC, as shown in FIGS. 11D and 11E, affecting its shape in a manner that may affect the quality of sleep the individual is able to achieve. By using one or more cushions 100 with volume-adjustable covers 10 according to this disclosure, as illustrated by FIGS. 11D and 11E (e.g., by additionally placing a cushion 100 between the individual's legs or knees to adjust an orientation of the individual's pelvis P, etc.), the individual's head H and/or pelvis P may be positioned at elevations and/or oriented in ways that will maintain the natural shape of the individual's spinal column SC as he or she lies on a surface, which may improve the individual's comfort as he or she lies on the surface, as well as the quality of sleep experienced by the individual.

Figure 14:
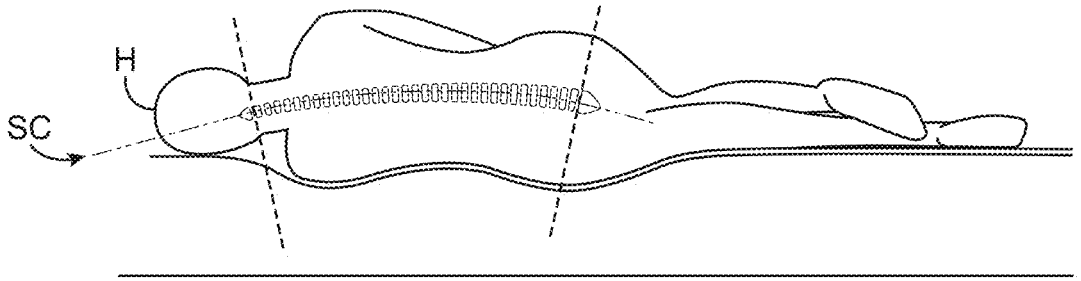
FIG. 14 illustrates an individual lying on her side with her head held at a relatively low elevation, as well as the effect of the position of her head on the shape of her spine.
Figure 15:
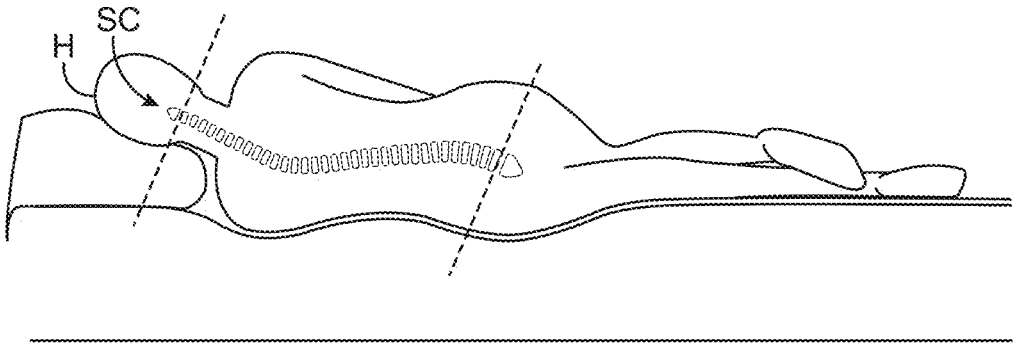
FIG. 15 illustrates an individual lying on her side with her head held at a relatively high elevation and her hips rotated, as well as the effect of the position of her head and the orientation of her pelvis on the shape of her spine.

Still referring to FIG. 13, as an individual lies on his or her side, as shown in FIG. 11F, the positions and/or orientations of the atlanto-axial joint AA and the sacroiliac joint SI may affect the lateral alignment of the spinal column SC, which is normally straight. FIG. 14 depicts the undesirable effects (e.g., misalignment, the stresses caused by misalignment, etc.) on the shape of an individual's spinal column SC as the individual lies on a surface (e.g., a mattress, etc.) with his or her head on a pillow that places his or her head H at an undesirably low elevation relative to the remainder of his or her body and without his or her pelvis rotated. FIG. 15 depicts the undesirable effects (e.g., misalignment, the stresses caused by misalignment, etc.) on the shape of an individual's spinal column SC as the individual lies on a surface (e.g., a mattress, etc.) with his or her head on a pillow that places his or her head H at an undesirably high elevation relative to the remainder of his or her body and without his or her pelvis rotated. FIG. 11F shows how one or more cushions 100 with volume-adjustable covers 10 according to this disclosure may be tailored in response to the manner in which the surface (e.g., the mattress, etc.) supports the individual's body to support the individual's head H, pelvis P, and/or other body parts in a manner that substantially maintains lateral (i.e., side-to-side) alignment of the individual's spinal column SC, which creates a neutral alignment of the spinal column SC), and, thus, minimizes stress on the individual's spinal column SC. Such use of one or more volume-adjustable covers 10 according to this disclosure to control angles of the attachment points at the end points of the closed kinematic chain of an individual's spinal column SC may have a greater effect on the shape of the individual's spinal column SC than the support surface $S_S$ (e.g., the mattress, etc.) that supports the individual, improving the individual's spinal alignment while he or she lies on the surface, regardless of the individual's preferred sleeping position. Improvements to the individual's spinal alignment improve the sleep outcomes experienced by the individual.

With returned reference to FIGS. 1-9B, prior to the development of the volume-adjustable cover 10 and cushions 100 including the same, pillows have been unable to affect alignment of an individual's spine as much or more than a surface on which the individual sleeps (e.g., a mattress, etc.). The volume-adjustable cover 20 may have as much of an effect on alignment of the spine as mattresses have purportedly had on alignment of the spine.

The range of adjustability a volume adjustable cover 10 provides for a cushion 100 may enable the cushion 100 to accommodate the global variations of the human anatomy and all of the various sleeping positions an individual may assume while the individual lies on any of a variety of types of sleep surfaces (e.g., mattresses, etc.). More specifically, the volume adjustable cover 10 has a design that makes it an easily adjustable sleeping tool that may tailor a cushion 100 that includes the individual's preferred infill material to the individual while the individual poses in their preferred sleeping position on their sleep surface (e.g., their mattress, etc.). When the expanded volume of the volume-adjustable cover 10 is only partially filled (i.e., by using a lesser quantity of infill material), the gathering element(s) 50 may impart a cushion 100 with greater loft powers that enable the cushion 100 to hold an object, such as an individual's head, at a fixed location over a sleep surface without substantially introducing tension the portion of the volume-adjustable cover 10 upon which the body part rests. The inventors are not aware of any other cushion that has the ability to increase the loft power of infill material within a pillow without significantly increasing tension in the covering of the pillow.

By personally tailoring such a cushion 100 to the individual in their sleeping position while on their sleep surface, the curvatures of the individual's spine and the orientations of the joints associated with the individual's spine may be fine-tuned to place the individual's unique spine in neutral alignment relationships that may be maintained as the individual rolls in and out of their preferred sleeping position. Thus, the volume adjustable cover 10 and the cushion 100 with which it is used provide the dynamic power to enable the individual to experience all five (5) stages of the sleep cycle and to achieve rejuvenative sleep (e.g., at least eight hours of sleep, etc.).

Considering the similarity of the spine to a mechanically closed kinematic chain and the predictable mechanical responses of a closed kinematic chain, the use of cushions 100 that include volume adjustable covers 10 according to this disclosure may control the curves of an individual's spine by controlling the positions of the individual's head and/or neck and pelvis and/or legs and, thus, by controlling the end points of the spine at the atlanto-occipital joint AO (C1 vertebra) and the sacroiliac joint SI. The ability to micro adjust the end points of the individual's spine controls the forces that enter and move through the spine by fine tuning the curvatures of the spine to achieve and maintain neutral alignment relationships. Maintaining the neutral alignment of the spine can trigger the automatic response of compensatory mechanisms of small muscle groups to assist in maintaining neutral spinal alignment without the involvement of the major muscle groups to protect the spinal joints as the individual sleeps.

By allowing the major muscle groups to rest, or be in slack, the spine may send sleep signals to the ARAS, which may, in turn, cause or enable the individual's body to experience all five (5) stages of the sleep cycle. These sleep signals may be accompanied by sleep signals that occur as a result of sensations (e.g., comfy, cushy, or cuddly feelings, etc.) that occur as an individual feels an infill material that he or she has chosen, or selected, for inclusion in the cushion 100. In addition, these sleep signals may be accompanied by sleep signals that occur as an individual assumes their preferred sleep position.

As the individual experiences deep sleep (e.g., D2), the glymphatic system associated with his or her central nervous system may activate. With the individual's spine in neutral alignment, the cerebrospinal fluid may properly flow throughout the individual's brain and spinal cord, flushing beta-amyloid plaque and other toxins from the individual's central nervous system.

Use of a cushion 100 that includes a volume adjustable cover 10 according to this disclosure may provide a variety of benefits. For example, by achieving neutral alignment of the spine and maintaining such neutral alignment as an individual moves in and out their sleeping position, the cushion 100 and its adjustable cover 10 may reduce the joint, muscle strains, and pains that can interrupt deep sleep. As another example, maintaining neutral alignment of an individual's spine may enable the individual's glymphatic system to function properly, removing toxins from the individual's central nervous system, which may prevent dirty brain diseases.

Although the preceding disclosure provides many specifics, these should not be construed as limiting the scope of any of the claims that follow, but merely as providing illustrations of some embodiments of elements and features of the disclosed subject matter. Other embodiments of the disclosed subject matter, and of their elements and features, may be devised which do not depart from the spirit or scope of any of the claims. Features from different embodiments may be employed in combination. Accordingly, the scope of each claim is limited only by its plain language and the legal equivalents thereto.

What is claimed:

1. A method for adjusting a length of a volume-adjustable cover for a cushion, the volume-adjustable cover having a first end, a second end spaced a distance from the first end, the distance defining a longitudinal axis extending between the first end and the second end, a receptacle extending between the first end and the second end and defining both a surface that surrounds the longitudinal axis between the first end and the second end and a volume interior to the surface, the receptacle configured to receive a cushioning element within the volume, and a first gathering element positioned adjacent the first end, the first gathering element configured to affect incremental changes in the volume by affecting incremental changes in a length of the receptacle, the first gathering element comprising a first engaging feature, a second engaging feature and a first material disposed between the first engaging feature and the second engaging feature, the method comprising the steps of:

incrementally urging the first engaging feature into engagement with the second engagement feature, from a relaxed arrangement toward a gathered arrangement, to reduce the length of the receptacle or incrementally urging the first engaging feature out of engagement with the second engagement feature, from a gathered arrangement toward a relaxed arrangement, to increase the length of the receptacle, wherein, when the first gathering element is in the relaxed arrangement, the first engaging feature extends continuously along a first region of the surface of the receptacle in a first helical direction about the longitudinal axis, from a first point to a second point, and along a second region of the surface of the receptacle in a first circumferential direction, parallel to a cutting plane oriented perpendicular to the longitudinal axis, from the second point to a third point, wherein, when the first gathering element is in the relaxed arrangement, the second engaging feature extends continuously along the first region of the surface of the receptacle in a second helical direction, the second helical direction opposite the first helical direction, about the longitudinal axis, from a fourth point to a fifth point, and along the second region of the surface of the receptacle in a second circumferential direction, parallel to the cutting plane, from the fifth point to a sixth point, and wherein the first gathering element extends at least 360° along the surface of the receptacle and about the longitudinal axis of the volume-adjustable cover.

2. The method of claim 1, wherein adjusting the length of the volume-adjustable cover includes compounded adjustment of the length of the volume-adjustable cover.

3. The method of claim 1, wherein adjusting the length of the volume-adjustable cover comprises adjusting the length of the volume-adjustable cover from an edge of the volume-adjustable cover.

4. The method of claim 1, wherein adjusting the length of the volume-adjustable cover comprises adjusting the length of the volume-adjustable cover from opposite ends of the volume-adjustable cover.

5. The method of claim 1, wherein adjusting the length of the volume-adjustable cover includes controlling a manner in which the cushion supports a load at a specific distance from a surface upon which the cushion is supported without changing load deflection attributes of the cushion.

6. The method of claim 1, wherein adjusting the length of the volume-adjustable cover comprises adjusting the length of the volume-adjustable cover to tailor the cushion to a particular sleep surface.

* * * * *